US007942519B2

(12) United States Patent
Takeuchi

(10) Patent No.: US 7,942,519 B2
(45) Date of Patent: May 17, 2011

(54) INK-JET RECORDING APPARATUS

(75) Inventor: Masaru Takeuchi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 588 days.

(21) Appl. No.: 12/023,241

(22) Filed: Jan. 31, 2008

(65) Prior Publication Data

US 2008/0211896 A1 Sep. 4, 2008

(30) Foreign Application Priority Data

Jan. 31, 2007 (JP) ..... 2007-022517

(51) Int. Cl.
*B41J 2/01* (2006.01)
*B41J 11/04* (2006.01)

(52) U.S. Cl. ..... 347/104; 347/8

(58) Field of Classification Search ..... 347/5, 8, 347/16, 101, 104, 107; 400/23, 29, 578, 400/642, 649, 654–656
See application file for complete search history.

(56) References Cited

U.S. PATENT DOCUMENTS 6,179,419 B1 * 1/2001 Rasmussen et al. ..... 347/104
7,673,985 B2 * 3/2010 Sasa ..... 347/104
7,703,869 B2 * 4/2010 Ota ..... 347/8
7,722,182 B2 * 5/2010 Sasa ..... 347/104
2006/0268087 A1 11/2006 Sasa
2007/0146463 A1 6/2007 Sasa

FOREIGN PATENT DOCUMENTS

JP 2002225357 A 8/2002
JP 2005153143 A 6/2005
JP 2006326990 A 12/2006

* cited by examiner

*Primary Examiner* — Daniel Petkovsek
(74) *Attorney, Agent, or Firm* — Baker Botts LLP

(57) ABSTRACT

An ink-jet recording apparatus according to one aspect comprises: a movable supporting member slidable in a conveying direction of a recording medium while supporting the recording medium to follow the recording medium conveyed; and an interlocking mechanism configured to control a movement of the movable supporting member. The interlocking mechanism is operable to: position the movable supporting member in a predetermined upstream position in the conveying direction when the recording medium is conveyed to the predetermined upstream position; retain the movable supporting member in the predetermined upstream position until the recording medium overhangs the movable supporting member to cover a contact portion and at least a part of a non-contact portion; and slide the movable supporting member toward a downstream side in the conveying direction while supporting an edge of the recording medium with the conveyance of the recording medium.

8 Claims, 25 Drawing Sheets

PRIOR ART

PRIOR ART

PRIOR ART

INK-JET RECORDING APPARATUS

CROSS-REFERENCE TO RELATED APPLICATIONS

This application is based upon and claims the benefit of priority from Japanese Patent Application No. 2007-022517 filed on Jan. 31, 2007, the entire contents of which are incorporated herein by reference.

TECHNICAL FIELD

One aspect of the present invention relates to an ink-jet recording apparatus configured to eject ink from a recording head to record an image on a recording medium.

BACKGROUND

FIG. 23 schematically shows the structure of an image recording unit of a general ink-jet recording apparatus.

The ink-jet recording apparatus includes a recording head 201. A number of nozzles are arranged side by side in a certain recording head 201. A recording medium 202 (such as recording sheet) on which an image is to be recorded is conveyed to below the recording head 201. The recording head 201 is moved in a direction orthogonal to a conveying direction 203 of the recording sheet 202, i.e., in a direction (main scanning direction) perpendicular to the sheet in this drawing. The recording head 201 ejects ink from the nozzles with predetermined timing while being moved. Thereby, an image is recorded on the recording sheet 202.

Recently, some ink-jet recording apparatus have a function to record an image on the recording sheet 202 like, for example, photographic printing. Such image recording is performed without providing a margin to an edge of the recording sheet 202, and is called what is called "borderless recording." When the borderless recording is performed, it is necessary to correctly maintain the distance between an edge of the recording sheet 202 and the recording head 201. Therefore, the platen 204 includes a movable rib 206 that slides in the conveying direction 203 in addition to fixed ribs 205. The movable rib 206 supports the recording sheet 202 from below, and follows the recording sheet 202 conveyed during image recording.

FIGS. 24A to 24C and FIGS. 25A to 25C schematically show the operation of sliding of the movable rib 206 in the conventional ink-jet recording apparatus.

As shown in FIG. 24A, the movable rib 206 slides to the upstream side in the conveying direction from the middle of the platen 204 in response to the conveyance of the recording sheet 202. That is, the movable rib 206 meets to support the leading edge of the recording sheet 202. The movable rib 206 slides to the position of an upstream end in the conveying direction as shown in FIG. 24B, and thereafter, slides to downstream side in the conveying direction as shown in FIG. 24C. That is, the movable rib 206 slides so as to follow the conveyance of the recording sheet 202 while supporting the recording sheet 202. This keeps the distance between the recording sheet 202 and the recording head 201 constant. Such ink-jet recording apparatus is disclosed in, for example, JP-A-2006-326990.

The movable rib 206 is slid in synchronization with the conveyance of the recording sheet 202 by a required sliding mechanism. However, the movable rib 206 may not be slid in synchronization with the conveyance of the recording sheet 202 due to mechanical errors or other factors of the sliding mechanism or a conveyor mechanism of the recording sheet 202. For example, in FIGS. 24A to 24C, the sliding initiation of the movable rib 206 is relatively too earlier than the conveyance of the recording sheet 202. Accordingly, the return of the movable rib 206 becomes too early, and the movable rib 206 will support the leading edge of the recording sheet 202. Therefore, when the recording head 201 begins to eject ink (see FIG. 24C), the ink adheres to a downstream portion of the movable rib 206 in the conveying direction. The ink adhering to the movable rib 206 may spread to the upper end of the movable rib 206, thereby soiling the recording sheet 202.

Further, in FIGS. 25A to 25C, the sliding initiation of the movable rib 206 is relatively too later than the conveyance of the recording sheet 202. Accordingly, when the recording head 201 begins to eject ink (see FIG. 25B), the movable rib 206 cannot support the recording sheet 202. Therefore, the ink adheres to the upper end of the movable rib 206, and the downstream portion thereof in the conveying direction. Moreover, as shown in FIG. 25C, the movable rib 206 returns after it has further slid to the upstream side in the conveying direction. Therefore, the ink adhering to the movable rib 206 will soil the rear surface of the recording sheet 202 severely.

Therefore, it is preferable that the position of a leading edge of the recording sheet 202 conveyed is sensed correctly, and sliding of the movable rib 206 is controlled on the basis of the position of the recording sheet 202. However, in order to realize such control, as well as a sensor that senses the position of a leading edge of the recording sheet 202 is specially needed, the sliding mechanism of the movable rib 206 also becomes complicated. This results in increased size and cost of an ink-jet recording apparatus.

In order to realize prevention of soiling of the movable rib 206 and the recording sheet 202 without adding a new sensor, etc., there may be provide means for adjusting the timing of sliding initiation of the movable rib 206 in view of a deviation in conveyance of a recording sheet. That is, assuming that the conveyance of the recording sheet 202 becomes relatively early, the timing of sliding of the movable rib 206 is advanced. Further, assuming that the conveyance of the recording sheet 202 becomes relatively late, the timing of sliding of the movable rib 206 is delayed.

However, for example, when the timing of movement initiation of the movable rib 206 is set to become late, actually, delay may not occur in conveyance of the recording sheet 202, or the conveyance of the recording sheet 202 may not become early. This is the same situation as a case where the timing of sliding of the movable rib 206 becomes relatively earlier than the timing of conveyance of the recording sheet 202. Therefore, when the recording head 201 begins to eject ink (refer FIG. 25B) as mentioned above, the movable rib 206 will not be able to support the recording sheet 202, but ink may adhere to the upper end of the movable rib 206 and the downstream portion thereof in the conveying direction. Accordingly, it is not possible to cope with a deviation in the conveying timing of the recording sheet 202 only by adjustment of the sliding initiation timing of the movable rib 206.

SUMMARY

One aspect of the invention has an object to provide an inexpensive ink-jet recording apparatus capable of preventing soiling of a recording medium and the inside of the apparatus caused by ink, and capable of performing high-quality borderless recording.

According to an aspect of the invention, an ink-jet recording apparatus comprises: a platen configured to support a recording medium conveyed in a conveying direction; a recording head disposed to face the platen and configured to eject ink to the recording medium conveyed onto the platen while reciprocating in a main scanning direction orthogonal to the conveying direction, thereby recording an image; a motor configured to generate energy to convey the recording medium located on the platen; a movable supporting member connected to the motor and slidable in the conveying direction while supporting the recording medium to follow the recording medium conveyed, the movable supporting member comprising a contacting portion to contact the recording medium during the conveyance on the platen and a non-contact portion continuous with the contact portion; and an interlocking mechanism configured to control a movement of the movable supporting member, wherein the interlocking mechanism is operable to: position the movable supporting member in a predetermined upstream position in the conveying direction when the recording medium is conveyed to the predetermined upstream position; retain the movable supporting member in the predetermined upstream position until the recording medium overhangs the movable supporting member to cover the contact portion and at least a part of the non-contact portion; and slide the movable supporting member toward a downstream side in the conveying direction while supporting an edge of the recording medium with the conveyance of the recording medium.

DESCRIPTION

Hereinafter, the illustrative, non-limiting embodiments will be described in detail with reference to the drawings. In addition, the embodiments are merely examples of the invention, and can be suitably changed without changing the scope of the invention.

1. Entire Configuration

Figure 1:
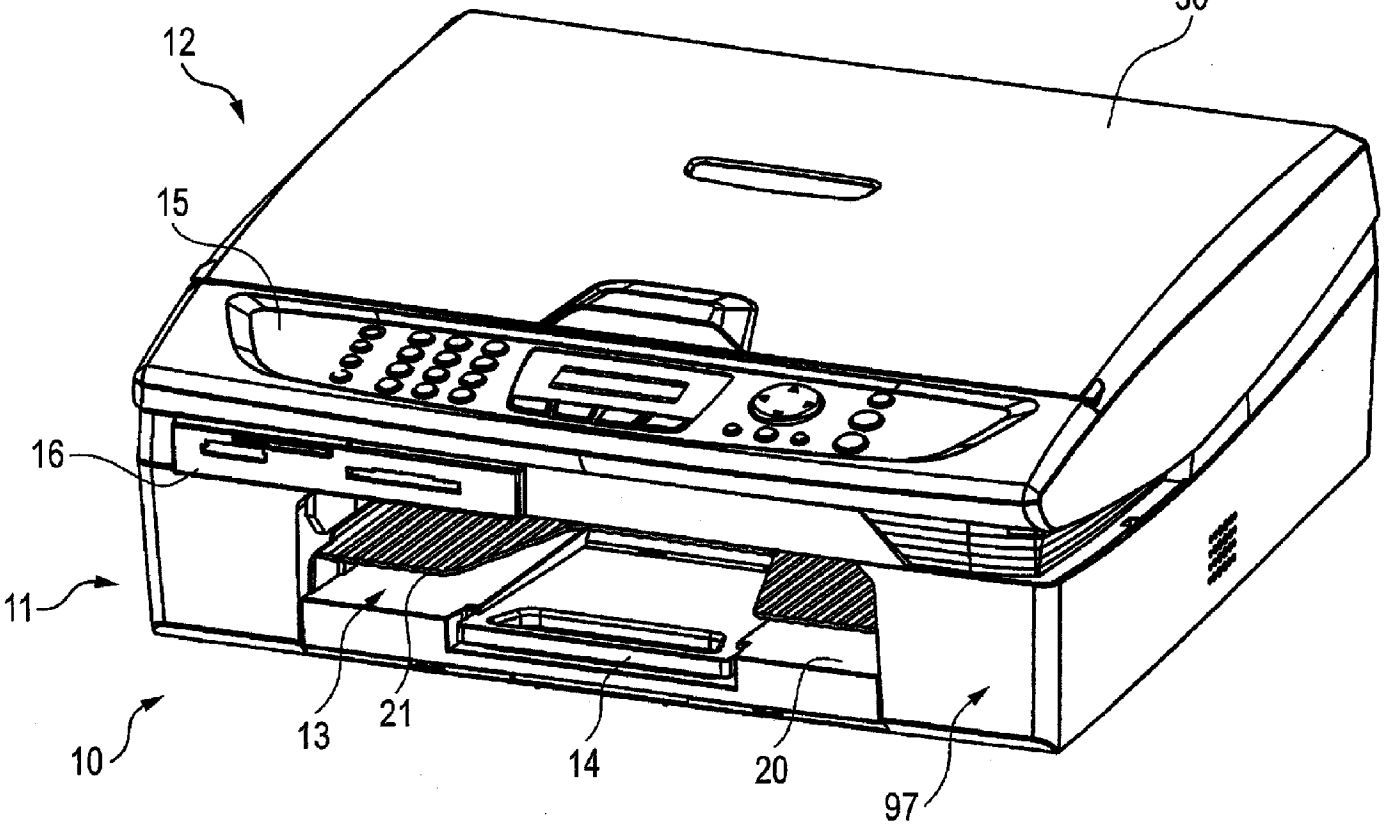
FIG. 1 is an appearance perspective view of a composite device according to one embodiment of the invention.
Figure 2:
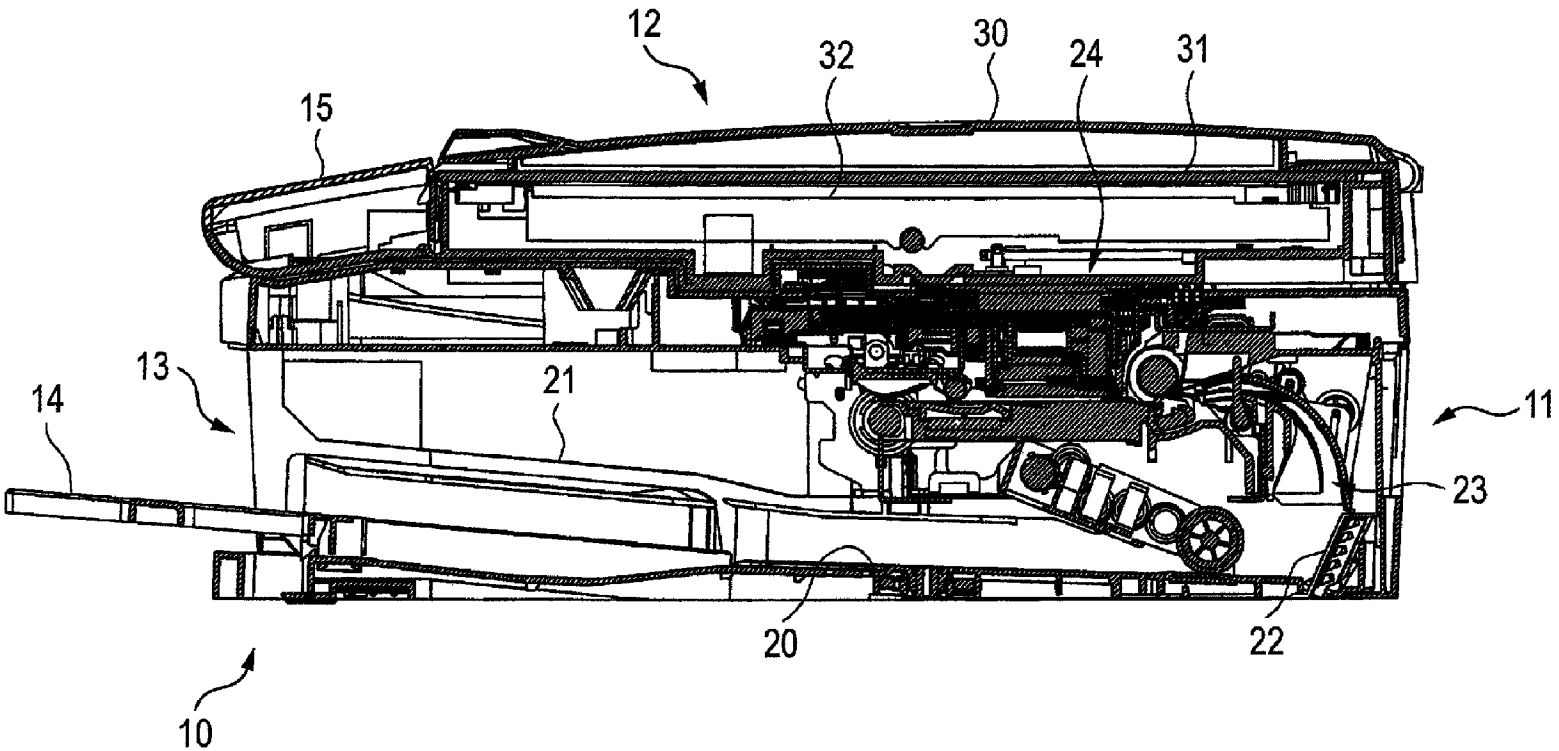
FIG. 2 is a longitudinal sectional view of the composite device according to one embodiment of the invention.

FIG. 1 is an appearance perspective view of a composite device 10 according to one embodiment of the invention. FIG. 2 is a longitudinal sectional view showing the internal configuration of the composite device 10.

The composite device 10 is a multi function device (MFD) including a printer unit 11 and a scanner unit 12 and having functions such as a printer function, a scanner function, a copying function and a facsimile function. The printer unit 11 of the composite device 10 is an example of an ink-jet recording apparatus. Accordingly, in the composite device 10, functions other than the printer function are arbitrary, and the ink-jet recording apparatus may be implemented as, for example, a single-function printer without having the scanner unit 12.

The printer unit 11 of the composite device 10 is connectable with, mainly, an external information apparatus, such as a computer. On the basis of print data including image data or document data transmitted from the computer, etc., the printer unit 11 records an image or a document on a recording sheet as a recording medium. Further, a digital camera, etc. may be connected to the composite device 10. On the basis of image data output from a digital camera, etc., the printer unit 11 records an image on a recording sheet. Moreover, the composite device 10 is also loaded with various storage media, such as a memory card. On the basis of image data recorded on the storage media, the printer unit 11 is also able to record an image on a recording sheet.

As shown in FIG. 1, the horizontal width and depth of the composite device 10 are set to be larger than the height thereof, and the profile shape of the composite device 10 is a substantially rectangular parallelepiped that is wide and thin. The printer unit 11 is provided at a lower portion of the composite device 10. The front of the printer unit 11 is provided with an opening 13. A sheet feed tray 20 and a sheet discharge tray 21 are provided as two upper and lower stages inside the opening 13. The sheet feed tray 20 stores recording sheets. The sheet feed tray 20 accommodates recording sheets of, e.g., below A4 size. However, the sheet feed tray 20 can also accommodate, for example, various sizes of recording sheets, such as B5 size below A4 size, and postcard size. The sheet feed tray 20 includes a slide tray 14. As shown in FIG. 2, the slide tray 14 is drawn out if necessary. When the slide tray 14 is drawn out, a tray face can be expanded, and thereby, the sheet feed tray 20 can also accommodate, for example, a legal-size recording sheet. Recording sheets accommodated in the sheet feed tray 20 are fed into the printer unit 11. The printer unit 11 records a desired image on a fed recording sheet, and the recording sheet on which image recording is made is discharged to the sheet discharge tray 21.

The scanning unit 12 is provided at an upper portion of the composite device 10. The scanner unit 12 is constituted as a so-called flatbed scanner. As shown in FIGS. 1 and 2, a document cover 30 is provided as a top plate of the composite device 10. The document cover 30 is openable and closable. A platen glass 31 and an image sensor 32 are provided below the document cover 30. A document to be read as an image is placed on the platen glass 31. The image sensor 32 is disposed underneath the platen glass 31. The main scanning direction of the image sensor 32 corresponds to the depth direction of the composite device 10 (horizontal direction in FIG. 2). The image sensor 32 is adapted to be reciprocable in the width direction of the composite device 10 (direction vertical to the sheet in FIG. 2).

An upper portion of the front of the composite device 10 is provided with an operation panel 15. The operation panel 15 is a unit for operating the printer unit 11 and the scanner unit 12. The operation panel 15 includes various operation buttons and a liquid-crystal display unit. The composite device 10 operates on the basis of an operation instruction from the operation panel 15. In a case where the composite device 10 is connected to an external computer, the composite device 10 operates even on the basis of an instruction transmitted via a printer driver or a scanner driver from the computer. Further, an upper left portion of the front of the composite device 10 is provided with slot portions 16 (see FIG. 1). Various storage media such as small-sized memory cards can be loaded into the slot portions 16. As a user performs a predetermined operation in the operation panel 15 with the slot portion 15 loaded with a small-sized memory card, image data stored in the small-sized memory card is read. Information about the read image data is displayed on the liquid-crystal display unit of the operation panel 15, and on the basis of this display, an arbitrary image is recorded on a recording sheet by the printer unit 11.

2. Outline of Printer Unit

Hereinafter, the internal configuration of the composite device 10, especially, the configuration of the printer unit 11 will be described.

As shown in FIG. 2, the sheet feed tray 20 is disposed at the bottom of the composite device 10. A separating inclined plate 22 is provided at the deep side of the sheet feed tray 20. The separating inclined plate 22 separates recording sheets fed from the sheet feed tray 20 to guide only an uppermost recording sheet upward. A sheet conveying path 23 is curved toward the front side after being directed upward from the separating inclined plate 22. Furthermore, the separating inclined plate 22 extends toward the front side from the rear side of the composite device 10, and leads to the sheet discharge tray 21 via the image recording unit 24. Accordingly, a recording sheet accommodated in the sheet feed tray 20 is guided so as to make a U turn upward from below along the sheet conveying path 23, leads to the image recording unit 24, is subjected to image recording by the image recording unit 24, and is then discharged to the sheet discharge tray 21.

Figure 3:
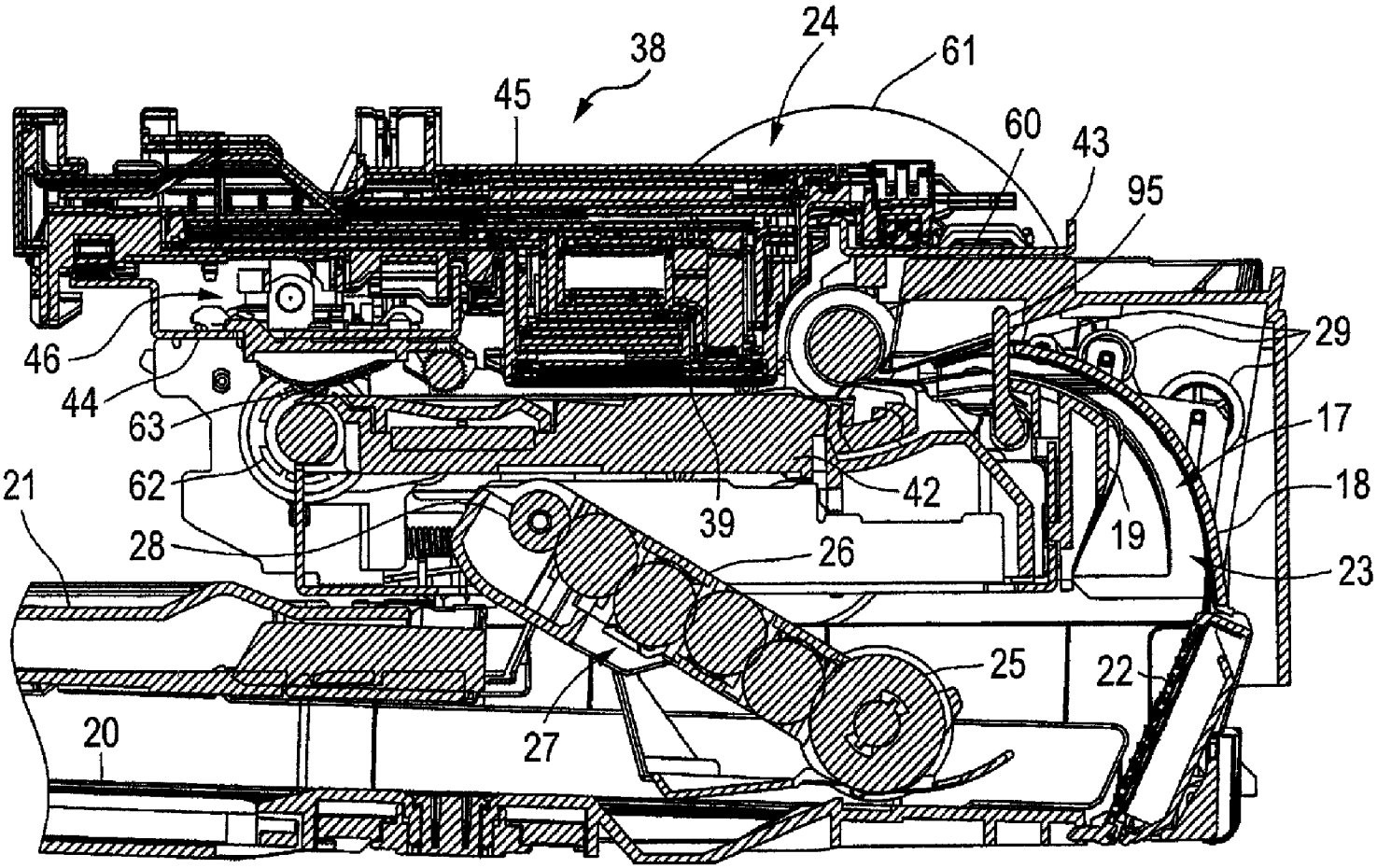
FIG. 3 is a partially enlarged sectional view of the composite device according to one embodiment of the invention.

FIG. 3 is a partially enlarged sectional view showing main components of the printer unit 11.

As shown in FIG. 3, a sheet feed roller 25 is provided above the bottom surface of the sheet feed tray 20. The sheet feed roller 25 supplies recording sheets loaded into the sheet feed tray 20 to the sheet conveying path 23. The sheet feed roller 25 is rotatably supported to a tip of a sheet feed arm 26. The sheet feed roller 25 is rotationally driven via a driving transmission mechanism 27 with an LF motor 71 (see FIG. 5) as a driving source. The driving transmission mechanism 27 has a plurality of gears, and is configured by meshing of the gears.

The sheet feed arm 26 is supported by a base shaft 28. A proximal end of the sheet feed arm 26 is supported by the base shaft 28, and is adapted to be rotatable with the base shaft 28 as a rotation center shaft. For this reason, the sheet feed arm 26 is movable up and down so that it can be brought close to or separated from the sheet feed tray 20. It is noted that the sheet feed arm 26 is urged by its own weight or spring, etc., and is rotated and urged downward. For this reason, the sheet feed arm 26 comes into contact with the sheet feed tray 20 normally, and when the sheet feed tray 20 is inserted or drawn out, the sheet feed arm is retreated upward. As the sheet feed arm 26 is rotationally driven downward, the sheet feed roller 25 comes into pressure contact with a recording sheet on the sheet feed tray 20. In this state, when the sheet feed roller 25 is rotated, the uppermost recording sheet is delivered to the separating inclined plate 22 by the frictional force between the surface of the sheet feed roller 25 and the recording sheet. The recording sheet is abutted on the separating inclined plate 22 at its tip, is guided upward, and is delivered into the sheet conveying path 23. When the uppermost recording sheet is delivered by the sheet feed roller 25, a recording sheet directly under the uppermost recording sheet may be delivered by both friction and action of static electricity, but the recording sheet is restrained by abutment on the separating inclined plate 22.

The sheet conveying path 23 is partitioned and formed by an outside guide surface and an inside guide surface except a place where the image recording unit 24 and the like are disposed. For example, a curved portion 17 of the sheet conveying path 23 at the rear side of the composite device 10 is formed by an outside guide member 18 and an inside guide member 19 which are fixed to a device frame. The outside guide member 18 forms the outside guide surface, and the inside guide member 19 forms the inside guide surface. The outside guide member 18 and the inside guide member 19 are disposed to face each other with a predetermined gap therebetween. Rollers 29 are provided in a place where the sheet conveying path 23 is curved. The rollers 29 are rotatable. The roller surface of the roller 29 is exposed to the outside guide surface. Accordingly, a recording sheet is smoothly conveyed even in place where the sheet conveying path 23 is curved.

As shown in FIG. 3, the image recording unit 24 is disposed on the sheet conveying path 23. The image recording unit 24 includes a carriage 38, and an ink-jet recording head 39 as an example of a recording head. The ink-jet recording head 39 is carried on the carriage 38. The carriage 38 is adapted to reciprocate in the main scanning direction. Ink cartridges are disposed independently from the ink-jet recording head 39 inside the composite device 10. In addition, the ink cartridges are not shown in FIG. 3. Individual color inks of cyan (C), magenta (M), yellow (Y), and black (Bk) are supplied to the ink-jet recording head 39 through ink tubes 41 (see FIG. 4) from the ink cartridges. While the carriage 38 reciprocates, individual color inks are selectively ejected as minute ink droplets from the ink-jet recording head 39. Thereby, an image is recorded on a recording sheet that is conveyed on the platen 42.

3. Recording Head Drive System

Figure 4:
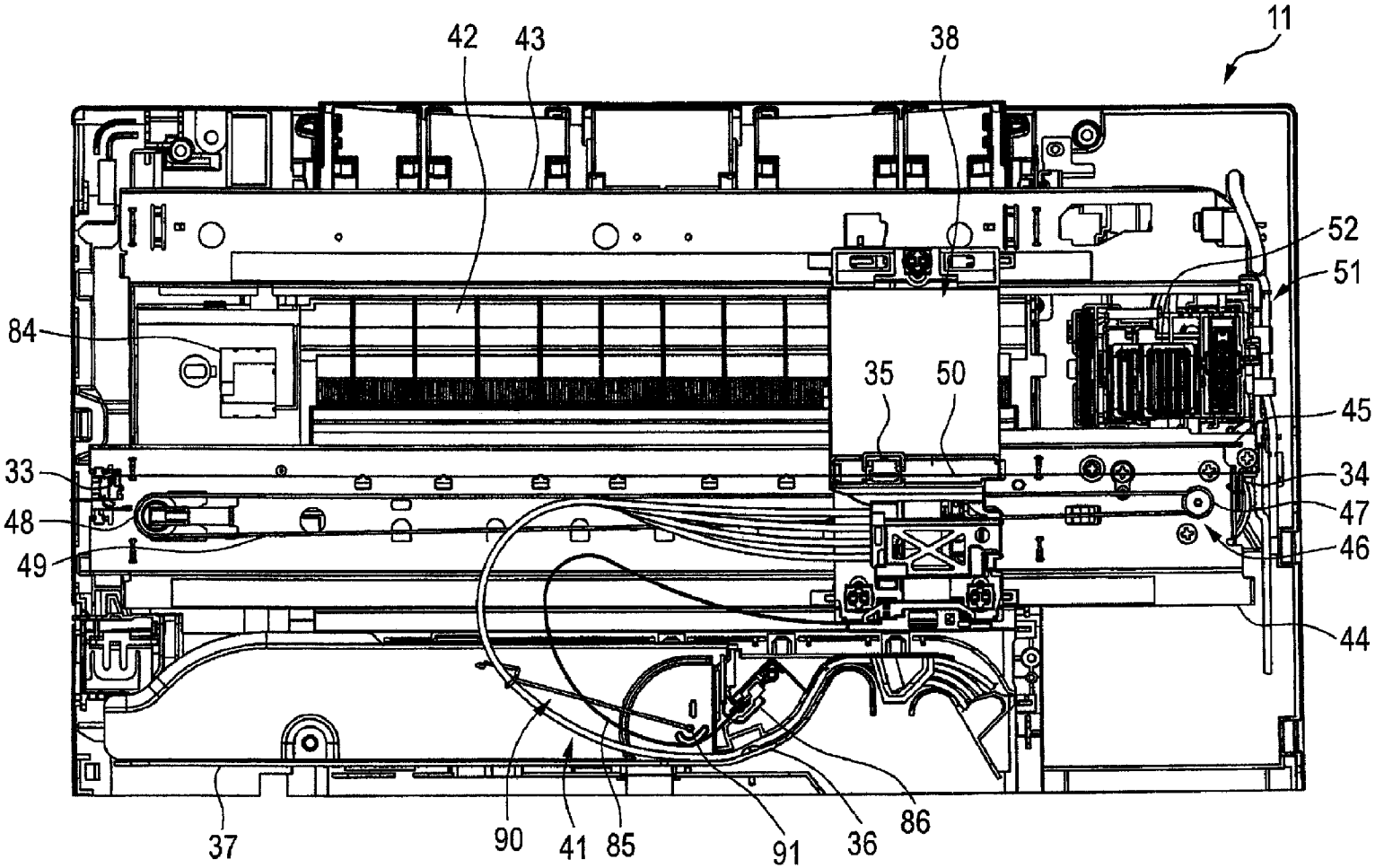
FIG. 4 is a plan view of the composite device according to one embodiment of the invention.
Figure 5:
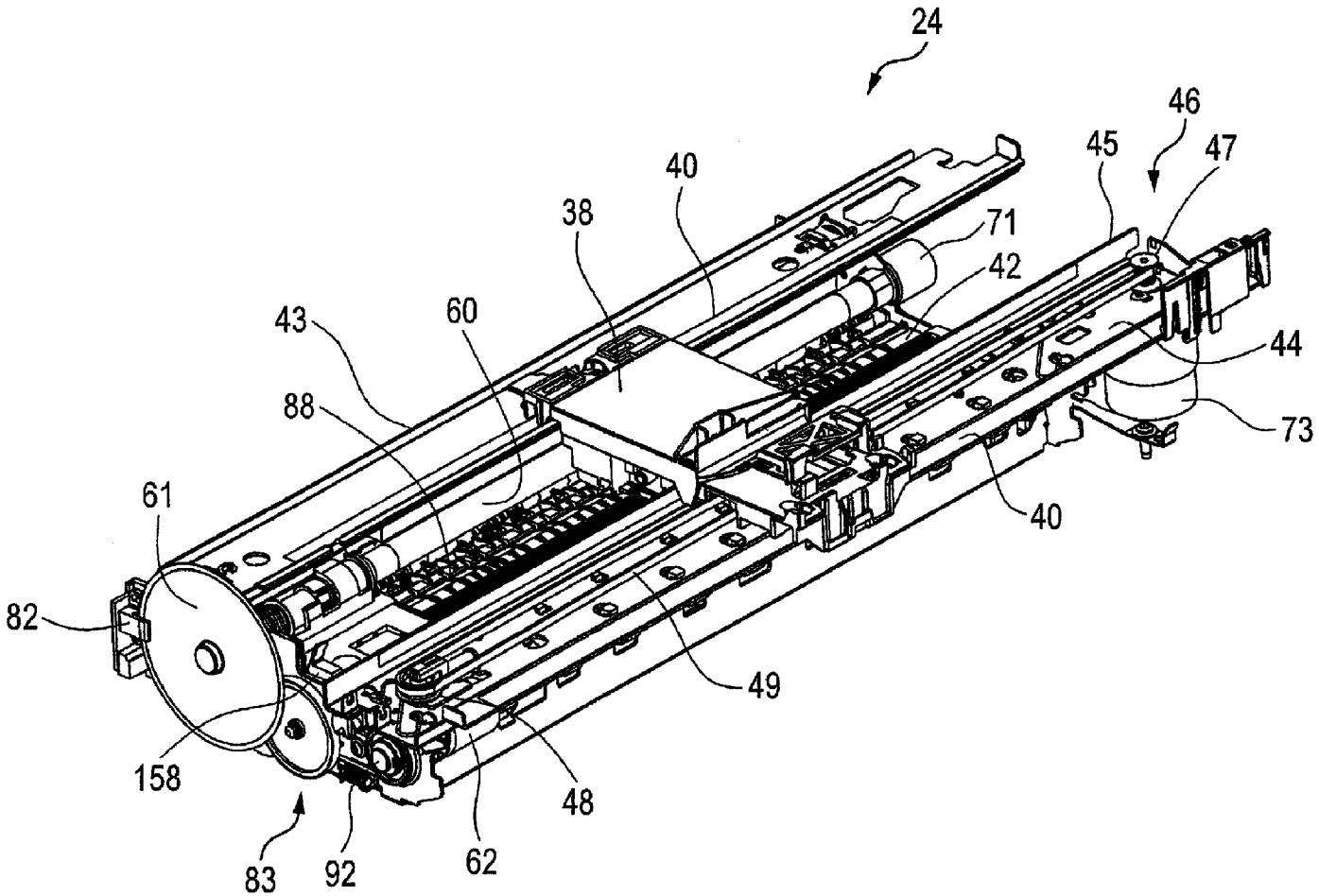
FIG. 5 is a plan view of a printer unit of the composite device according to one embodiment of the invention.

FIG. 4 is a plan view showing main parts of the printer unit 11. FIG. 4 shows the configuration of, mainly, the device rear side portion than the middle of the printer unit 11. Further, FIG. 5 is a perspective view showing main parts of the printer unit 11. FIG. 5 shows the configuration of the image recording unit 24.

As shown in FIGS. 4 and 5, a pair of guide rails 43 and 44 are disposed above the sheet conveying path 23. The guide rails 43 and 44 face each other at a predetermined distance in the conveying direction (direction that turns from the upside of the sheet to the downside thereof in FIG. 4) of a recording sheet. The guide rails 43 and 44 extend in a direction (horizontal direction in FIG. 4) orthogonal to the conveying direction of a recording sheet. The guide rails 43 and 44 are provided in a housing of the printer unit 11, and forms a portion of a frame that supports individual members that constitutes the printer unit 11. The carriage 38 is laid between the guide rails 43 and 44. That is, the carriage 38 is disposed so as to straddle the guide rails 43 and 44, and slides in a direction orthogonal to the conveying direction of a recording sheet with respect to guide rails 43 and 44. In addition, as the guide rails 43 and 44 are arranged almost horizontally with the conveying direction of a recording sheet as such, the height of the printer unit 11 becomes low, and the device can be made thin.

The guide rail 43 disposed on the upstream side in the conveying direction of a recording sheet is formed in the shape of a flat plate. The length of the guide rail 43 in the width direction (horizontal direction in FIG. 4) of the sheet conveying path 23 is set to be larger than the reciprocation range of the carriage 38. Further, the guide rail 44 disposed on the downstream side in the conveying direction of a recording sheet is also formed in the shape of a flat plate. The length of the guide rail 44 in the width direction of the sheet conveying path 23 is set to be almost the same size than the guide rail 43. An upstream end of the carriage 38 in the conveying direction is placed on the guide rail 43, and a downstream end of the carriage 38 in the conveying direction is placed on the guide rail 44. The carriage 38 is adapted to slide in the longitudinal direction of each of the guide rails 43 and 44.

An upstream edge 45 of the guide rail 44 in the conveying direction is bent at almost the right angle upward. The carriage 38 supported by the guide rails 43 and 44 nips the edge 45. Specifically, the carriage 38 includes a nipping member, as a roller pair, and the nipping member nips the edge 45. Thereby, although the carriage 38 is positioned in the conveying direction of a recording sheet, the carriage can be slid in the direction orthogonal to the conveying direction of a recording sheet with respect to the guide rails 43 and 44. That is, the carriage 38 reciprocates in the direction orthogonal to the conveying direction of a recording sheet with the edge 45 of the guide rail 44 as a base. In addition, although not shown, lubricant, such as grease, is applied to the edge 45 in order to make sliding of the carriage 38 smooth.

A belt driving mechanism 46 is disposed on the top surface of the guide rail 44. The belt driving mechanism 46 has a driving pulley 47, a driven pulley 48, and an endless annular timing belt 49. The driving pulley 47 and the driven pulley 48 are respectively disposed in the vicinity of both ends of the sheet conveying path 23 in its width direction. Teeth are provided inside the endless annular timing belt 49, and the timing belt 49 is laid between the driving pulley 47 and the driven pulley 48. The driving pulley 47 is driven by a CR motor 73 (see FIG. 5). The timing belt 49 makes a circumferential motion by rotation of the driving pulley 47. In addition, the timing belt 49 can adopt a belt in which both ends of an ended belt are secured to the carriage 38 other than the endless annular belt.

The carriage 38 is secured to the timing belt 49. Accordingly, on the basis of the circumferential motion of the timing belt 49, the carriage 38 reciprocates on the guide rails 43 and 44. Since the ink-jet recording head 39 is carried on the carriage 38 as mentioned above, the ink-jet recording head 39 reciprocates in the width direction of the sheet conveying path 23 as the main scanning direction, in association with the carriage 38.

As shown in FIG. 4, an encoder strip 50 of a linear encoder 77 (see FIG. 8) is disposed in the guide rail 44. The encoder strip 50 is formed like a belt, and is made of transparent resin. A pair of supporting portions 33 and 34 is formed at both ends (ends of the carriage 38 in the reciprocation direction) of the guide rail 44. The supporting portions 33 and 34 protrude from the top surface of the guide rail 44. Specifically, the supporting portions 33 and 34 are formed by cutting and raising the top surface of the guide rail 44. Both ends of the encoder strip 50 are locked to the supporting portions 33 and 34, and the encoder strip 50 is provided along the edge 45 of the guide rail 44. In addition, although not shown in this drawing, a leaf spring is provided in any one of the supporting portions 33 and 34, and an end of the encoder strip 50 is locked to the leaf spring. By providing the leaf spring, the encoder strip 50 is prevented from being loosened in its longitudinal direction. Further, in a case where an external force acts on the encoder strip 50, the leaf spring resiliently deforms such that the encoder strip 50 is flexed.

The encoder strip 50 includes light-transmitting portions that transmit light and light-shielding portions that shield light. The light-transmitting portions and the light-shielding portions are alternately disposed at predetermined pitches in the longitudinal direction of the encoder strip 50 to form a predetermined pattern. An optical sensor 35 that is a transmissive sensor is provided on the top surface of the carriage 38. The optical sensor 35 is provided in a position corresponding to the encoder strip 50. The optical sensor 35 reciprocates along the longitudinal direction of the encoder strip 50 together with the carriage 38, and detects the pattern of the encoder strip 50 during its reciprocation. The ink-jet recording head 39 includes a head control board that controls ejection of ink. The head control board outputs a pulse signal on the basis of a detection signal of the optical sensor 35. The position of the carriage 38 is determined on the basis of the pulse signal, and thereby, reciprocation of the carriage 38 is controlled. In addition, the head control board is covered with a head cover of the carriage 38, and the head control board is not shown in FIGS. 4 and 5.

As shown in FIGS. 3 and 4, the platen 42 is disposed below the sheet conveying path 23. The platen 42 is disposed to face the ink-jet recording head 39. The platen 42 is disposed over a central portion through which a recording sheet passes, in the reciprocation range of the carriage 38. The width of the platen 42 is set to be sufficiently larger than the maximum width of a recording sheet that can be conveyed. Both edges of a recording sheet always pass over the platen 42. Although explained below in more detail, the platen 42 is provided with a movable supporting member 88 (see FIG. 5). The movable supporting member 88 moves in the conveying direction so as to follow the recording sheet that is conveyed over the platen 42 so that the edges of the recording sheet may always be supported.

In a range through which a recording sheet does not pass, i.e., beyond an image recording range of the ink-jet recording head 39, as shown in FIG. 4, maintenance units, such as a purging mechanism 51 and a waste ink tray 84, are disposed. The purging mechanism 51 sucks and removes bubbles or foreign matters from nozzles 53 (see FIG. 6) of the ink-jet recording head 39. The purging mechanism 51 includes a cap 52 configured to cover the nozzles 53 of the ink-jet recording head 39, a pump mechanism connectable to the ink-jet recording head 39 through the cap 52, and a moving mechanism that allows the cap 52 to be brought close to and separated from the nozzles 53 of the ink-jet recording head 39. In addition, as shown in FIG. 4, the pump mechanism and the moving mechanism are located below the guide frame 44, and they are not shown in the drawing.

When bubbles, etc. are to be sucked and removed from the ink-jet recording head 39, the carriage 38 is moved so that the ink-jet recording head 39 may be located on the cap 52. In that state, the cap 52 moves upward. The cap 52 adheres tightly to the bottom surface of the ink-jet recording head 39, and thereby seals the nozzles 53. As the internal pressure of the cap 52 is made negative by the pump mechanism, ink is sucked from the nozzles 53 of the ink-jet recording head 39. Bubbles or foreign matters in the nozzles 53 are sucked and removed along with this ink.

The waste ink tray 84 receives idle ejection of ink from the ink-jet recording head 39 called flushing. The waste ink tray 84 is disposed on the top surface of the platen 42. The waste ink tray 84 is provided within the reciprocation range of the carriage 38, and outside the image recording range. In addition, felt is laid in the waste ink tray 84. The brushed ink is absorbed into and held by the felt. By providing the maintenance units, maintenance, such as removal or drying prevention of bubbles or mixed color ink in the ink-jet recording head 39 is performed.

As shown in FIG. 1, a door 97 is provided at the front of the housing of the printer unit 11 so as to be openable and closable. When the door 97 is opened, a cartridge mounting portion will be exposed to the device front side. A user can mount or remove ink cartridges to/from the cartridge mounting portion. Although not shown in this drawing, the cartridge mounting portion is partitioned into four accommodating chambers corresponding to the ink cartridges. Ink cartridges that hold individual color inks of cyan, magenta, yellow, and black color inks are accommodated in the accommodating chambers, respectively, of the cartridge mounting portion. Four ink tubes 41 corresponding to the individual color inks are routed from the cartridge mounting portion to the carriage 38. As mentioned above, each color ink is supplied to the ink-jet recording head 39 through each of the ink tubes 41 from an ink cartridge carried on the carriage 38.

As shown in FIG. 4, the ink tubes 41 are made of synthetic resin, and have such flexibility that they are flexed so as to follow reciprocation of the carriage 38. The ink tubes 41 led out of the cartridge mounting portion are drawn out to the vicinity of the center of the device along its width direction, and are first fixed to a fixing clip 36 of a device body. Each of the ink tubes 41 is not fixed to the device body, etc. at its portion from the fixing clip 36 to the carriage 38, and this portion changes in posture in accordance with the reciprocation of the carriage 38. In addition, as shown in FIG. 4, the ink tubes 41 that extend from the fixing clip 36 toward the cartridge mounting portion are omitted.

The ink tubes 41 are routed so as to form curved portions that are reversed in the reciprocation direction of the carriage 38, at their portions from the fixing clip 36 to the carriage 38. In other words, the ink tubes 41 are routed so as to form a substantially U shape in plan view. The four ink tubes 41 are arranged side by side in the horizontal direction along the conveying direction of a recording sheet in the carriage 38. The ink tubes 41 extend in the reciprocation direction of the carriage 38. On the other hand, the fixing clip 36 fixes the four ink tubes 41 so that they may be stacked in the vertical direction. The fixing clip 36 is a U-shaped member that has an opening formed at its top. The ink tubes 41 are inserted into the opening, and the ink tubes 41 are nipped in a state where they are stacked in the vertical direction by the fixing clip 36. That is, the four ink tubes 41 are curved substantially in the shape of the letter U as a whole, while being twisted so that a horizontal arrangement may become a vertical arrangement from the carriage 38 toward the fixing clip 36.

The lengths of the four ink tubes 41 from the carriage 38 to the fixing clip 36 are made approximately equal to one another. In the carriage 38, an ink tube 41 disposed on the most upstream side in the conveying direction of a recording sheet is disposed on the uppermost side of the fixing clip 36. The other ink tubes 41 are disposed so as to be adjacent to the ink tubes 41 concerned. Since the lengths of the ink tubes 41 are approximately equal to one another, the center of the substantially U-shaped curved portion of each of the ink tubes 41 is curved so as to deviate in the recording sheet conveying direction according to the arrangement of the carriage 38 in the recording sheet conveying direction. Thereby, in the curved portion, the four ink tubes 41 are aligned in an oblique direction from the upper side toward the lower side, and when the ink tubes change in posture so as to follow the carriage 38, any interference between the ink tubes 41 is reduced. In addition, although the four ink tubes 41 are shown in the present embodiment, in a case where the ink tubes 41 are further increased in number, similarly, they are sequentially disposed on the upper side of the fixing clip 36 from an ink tube 41 on the upstream side in the recording sheet conveying direction in the carriage 38.

Transmission of a recording signal from a main board that constitutes a control unit 64 (see FIG. 8) to a head control board of the ink-jet recording head 39 is performed through a flat cable 85. The flat cable 85 electrically connects the main board and the head control board to each other. In addition, the main board is disposed at the device front side (lower side in FIG. 4), and is not shown in FIG. 4. The flat cable 85 is a thin belt-like cable that is insulated by covering a plurality of conductive lines, each transmits electric signal, with a synthetic resin film such as a polyester film.

The flat cable 85 has such flexibility that it is flexed so as to follow reciprocation of the carriage 38. As shown in FIG. 4, the portion of the flat cable 85 from the carriage 38 to the fixing clip 86 forms a curved portion that is reversed in the reciprocation direction of the carriage 38. The direction in which the flat cable 85 extends from the carriage 38, and the direction in which the ink tubes 41 extend are the same direction as the reciprocation direction of the carriage 38.

One end of the flat cable 85 fixed to the carriage 38 is electrically connected to the head control board carried on the carriage 38. The other end of the flat cable 85 fixed to the fixing clip 86 is electrically connected to the main board. The flat cable 85 is not fixed to any member at its portion that is curved substantially in the U-shape, and similarly to the ink tubes 41, this portion changes in posture in accordance with the reciprocation of the carriage 38. As such, the ink tubes 41 and the flat cable 85 that change in posture so as to follow the reciprocation of the carriage 38 are supported by a rotation supporting member 90. An end of the rotation supporting member 90 is rotatably supported by a bearing 91. Accordingly, the rotation supporting member 90 may pivot around the bearing 91.

A regulation wall 37 is provided, which extends in the width direction (horizontal direction in FIG. 4) of the device. The regulation wall 37 is disposed closer to the device front side than the ink tubes 41 and the flat cable 85 (lower side in FIG. 4). The regulation wall 37 has a vertical wall surface that abuts on the ink tubes 41. The regulation wall 37 is erected linearly in the reciprocation direction of the carriage 38. In other words, the regulation wall 37 extends in the extending direction of the ink tubes 41 from the fixing clip 36 that fixes the ink tubes 41. The height of the regulation wall 37 is set such that the regulation wall 37 abuts on all the four ink tubes 41 that are arrayed in the vertical direction by the fixing clip 36. The ink tubes 41 extend along the regulation wall 37 from the fixing clip 36. The ink tubes 41 abut on the wall surface of the regulation wall 37 on the device rear side, and thereby, the ink tubes 41 are restrained from swelling toward the device front side, i.e., in a direction in which they are away from the carriage 38.

The fixing clip 36 is disposed substantially in the vicinity of the middle of the device in its width direction. The fixing clip 36 fixes the ink tubes 41 so that the ink tubes 41 may extend toward the regulation wall 37. The vertical wall surface of the regulation wall 37 and the direction in which the fixing clip 36 makes the ink tubes 41 extend form an obtuse angle that is smaller than 180° in plan view. Although the ink tubes 41 have flexibility, they also have moderate flexural rigidity. Accordingly, the ink tubes 41 are pressed against the wall surface of the regulation wall 37 as they extend at an angle with respect to the regulation wall 37 by the fixing clip 36. Thereby, in the reciprocation range of the carriage 38, the range within which the ink tubes 41 extend along the regulation wall 37 becomes wide, and consequently, a region where the portions from the curved portions of the ink tubes 41 to the carriage 38 swell toward the device rear side, i.e., toward the carriage 38 can be made small.

The fixing clip 86 is provided in a position that becomes curved inside from the fixing clip 36 substantially in the vicinity of the middle of the device in its width direction. The fixing clip 86 fixes the flat cable 85 so that the flat cable 85 may extend toward the regulation wall 37. The vertical wall surface of the regulation wall 37 and the direction in which the fixing clip 86 makes the flat cable 85 extend make an obtuse angle that is smaller than 180° in plan view. Although the flat cable 85 has flexibility, it also has moderate flexural rigidity. Accordingly, the flat cable 85 is pressed against the wall surface of the regulation wall 37 as it extends at an angle with respect to the regulation wall 37 by the fixing clip 86. Thereby, in the reciprocation range of the carriage 38, the range within which the flat cable 85 extend along the regulation wall 37 becomes wide, and consequently, a region where the portion from the curved portion of the flat cable 85 to the carriage 38 swells toward the device rear side, i.e., toward the carriage 38 can be made small.

4. Structure of Recording Head

Figure 6:
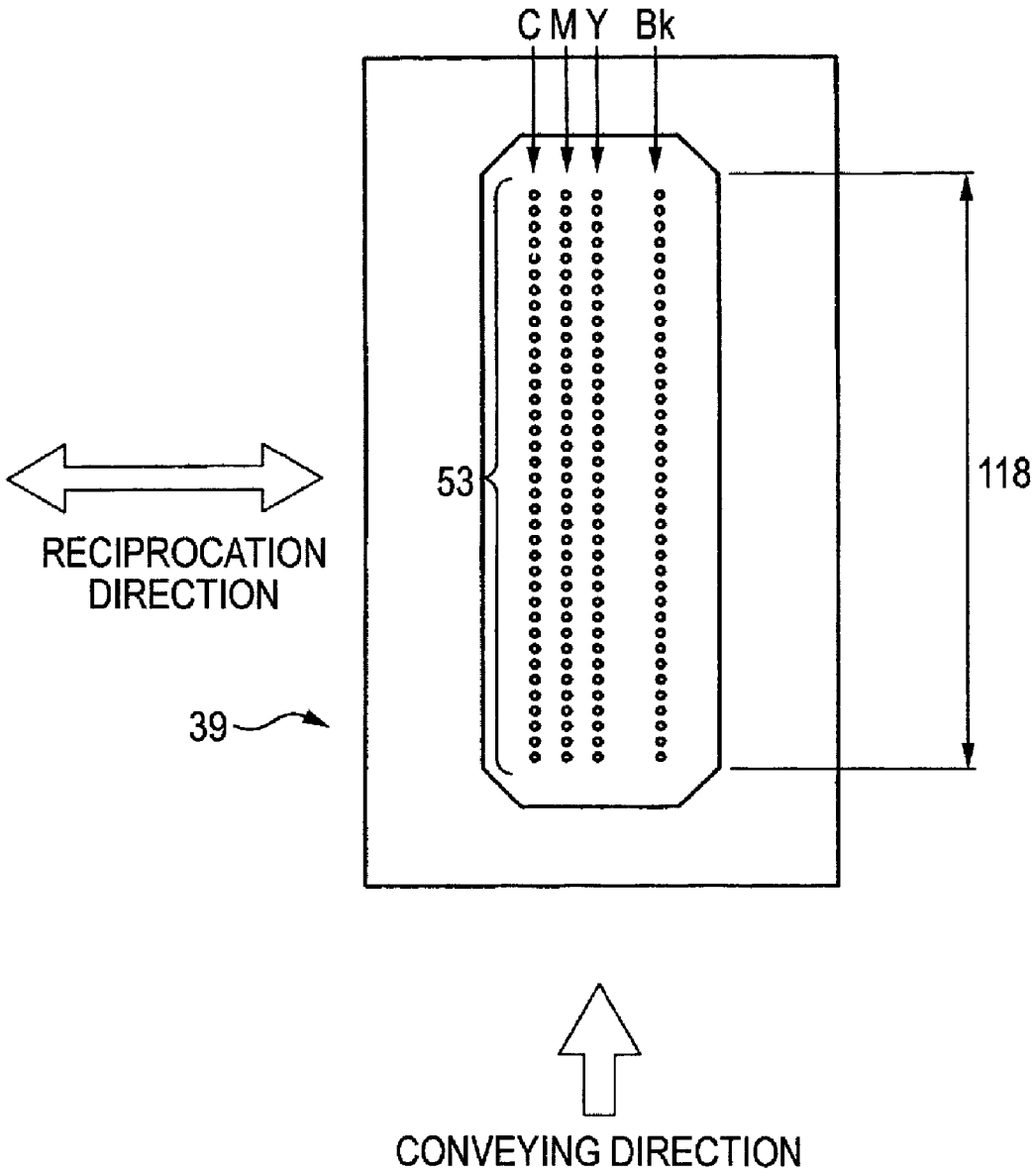
FIG. 6 is an enlarged bottom view of an ink-jet recording head of the composite device according to one embodiment of the invention.

FIG. 6 is a bottom view of the ink-jet recording head 39. This drawing shows a nozzle formation surface of the ink-jet recording head 39.

As shown in FIG. 6, a bottom surface of the ink-jet recording head 39 is provided with the nozzles 53. The nozzles 53 are arrayed in the conveying direction of a recording sheet in correspondence with individual color inks of cyan (C), magenta (M), yellow (Y), and black (Bk). In addition, in this drawing, the vertical direction is the conveying direction of a recording sheet, and the horizontal direction is the reciprocation direction of the carriage 38. A plurality of nozzles 53 corresponding to individual color inks of CMYBk makes rows, respectively, in the conveying direction of a recording sheet. Further, the rows of the nozzles 53 corresponding to the individual color inks are arranged in the reciprocation direction of the carriage 38. The pitch or number of the nozzles 53 in the conveying direction are suitably set according to the resolution, etc. of an image to be recorded. Further, the row number of the nozzles 53 may be increased according to the kinds of color inks.

Figure 7:
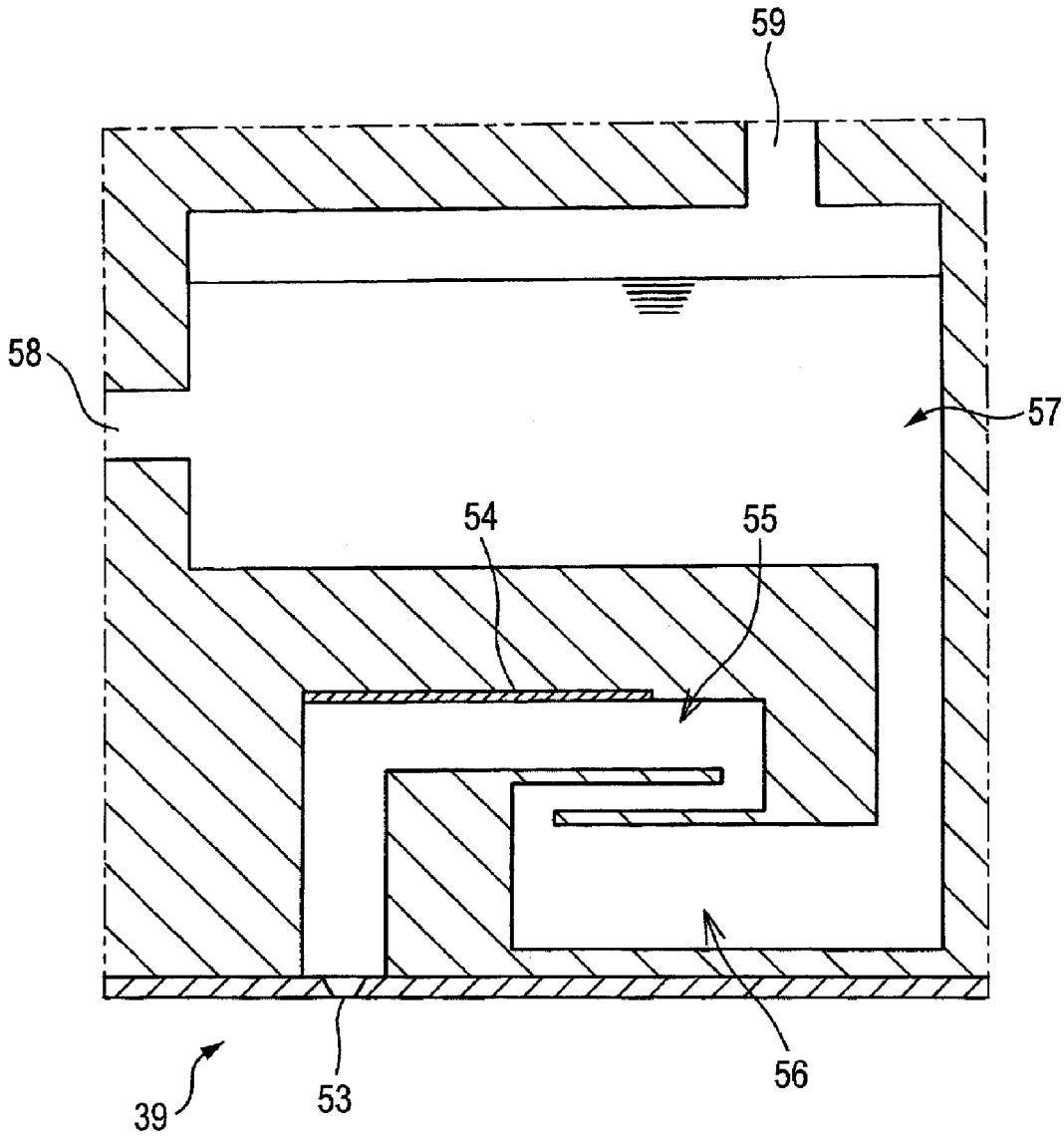
FIG. 7 is a partially enlarged sectional view showing the internal configuration of the ink-jet recording head 39.

FIG. 7 is a partially enlarged sectional view showing the internal configuration of the ink-jet recording head 39.

As shown in FIG. 7, a cavity 55 including a piezoelectric element 54 is formed on the upstream side of a nozzle 53 formed in the bottom surface of the ink-jet recording head 39. The piezoelectric element 54 is deformed as a predetermined voltage is applied thereto, thereby reducing the volume of the cavity 55. By the change of the capacity of the cavity 55, the ink in the cavity 55 is ejected as ink droplets from the nozzle 53.

The cavity 55 is provided in every nozzle 53. A manifold 56 is formed over a plurality of cavities 55. The manifold 56 is provided for every color ink of CMYBk. A buffer tank 57 is disposed on the upstream side of the manifold 55. The buffer tank 57 is also provided for every color ink of GMYBk. Ink is supplied to each buffer tank 57. This ink is supplied from an ink supply port 58 via an ink tube 41. As ink is once reserved in the buffer tank 57, bubbles generated in ink in the ink tube 41, etc., thereby preventing the bubbles from entering the cavity 55 and the manifold 56. The bubbles caught within the buffer tank 57 are sucked and removed by a pump mechanism through a bubble drain port 59.

An individual color ink supplied to the buffer tank 57 through an ink tube 41 from an ink cartridge is distributed to each cavity 55 via the manifold 56 from the buffer tank 57. The individual color ink of CMYBk supplied through such an ink channel is ejected as ink droplets to a recording sheet from the nozzle 53 by deformation of the piezoelectric element 54.

5. Sheet Conveyance System

As shown in FIG. 3, a pair of a conveying roller 60 and a pinch roller is provided on the upstream side of the image recording unit 24. Although the pinch roller is hidden by other members, and is not shown in FIG. 3, the pinch roller is disposed so as to come into pressure contact with the lower side of the conveying roller 60. The conveying roller 60 and the pinch roller nip a recording sheet conveyed through the sheet conveying path 23 to convey it onto the platen 42. Further, a pair of a sheet discharge roller 62 and a spur roller 63 are provided on the downstream side of the image recording unit 24. The sheet discharge roller 62 and the spur roller 63 nip a recorded recording sheet to convey it to the sheet discharge tray 21. A driving force is transmitted to the conveying roller 60 and the sheet discharge roller 62 from the LF motor 71. The conveying roller 60 and the sheet discharge roller 62 are driven intermittently, thereby feeding a recording sheet with predetermined linefeed width. In addition, the conveying roller 60 and the sheet discharge roller 62 are synchronized with each other in rotation. A rotary encoder 76 (see FIG. 8) provided in the conveying roller 60 detects the pattern of an encoder disk 61, which rotates with the conveying roller 60, using the optical sensor 82 (see FIG. 5). On the basis of this detection signal, the rotation of the conveying roller 60 and the rotation of the sheet discharge roller 62 are controlled.

The spur roller 63 comes into pressure contact with a recorded recording sheet. The surface of the spur roller 63 is uneven in the shape of a spur so that an image recorded on the recording sheet may not deteriorate. The spur roller 63 is provided so as to be slidable in a direction in which it is brought close to or separated from the sheet discharge roller 62. The spur roller 63 is urged by a coil spring so as to come into pressure contact with the sheet discharge roller 62. When a recording sheet advances between the sheet discharge roller 62 and the spur roller 63, the spur roller 63 is retreated against the urging force of the coil spring by the thickness of a recording sheet. A recording sheet is brought into pressure contact with the sheet discharge roller 62. This allows the rotatory power of the sheet discharge roller 62 to be reliably transmitted to a recording sheet. The pinch roller is similarly provided with respect to the conveying roller 60. Accordingly, a recording sheet is brought into pressure contact with the conveying roller 60, and thereby, the rotatory power of the conveying roller 60 is reliably transmitted to the recording sheet.

A registration sensor 95 is disposed further upstream than the conveying roller 60 in the sheet conveying path 23. The registration sensor 95 includes a detecting element shown in FIG. 3, and an optical sensor that is not shown. The detecting element is disposed so as to traverse the sheet conveying path 23, and is able to protrude into and retract from the sheet conveying path 23. The detecting element is resiliently urged so as to always protrude into the sheet conveying path 23. As a recording sheet that is conveyed through the sheet conveying path 23 abuts on the detecting element, the detecting element retracts from the sheet conveying path 23. The optical sensor is turned on or turned off by protrusion and retraction of the detecting element. Accordingly, when a recording sheet causes the detecting element to protrude and retract, the position of a front end or trailing edge of the recording sheet in the sheet conveying path 23 or a rear end is detected.

In the composite device 10, the LF motor 71 serves a driving source for feeding of a recording sheet from the sheet feed tray 20, and serves as a driving source for conveyance of a recording sheet located on the platen 42, or for discharge of a recorded recording sheet to the sheet discharge tray 21. That is, the LF motor 71 drives the sheet feed roller 25 via the driving transmission mechanism 27 as mentioned above (see FIG. 3) while driving the conveying roller 60 (see FIG. 5). Moreover, the LF motor 71 drives a sheet discharge roller shaft to which the sheet discharge roller 62 is attached via a predetermined power transmission mechanism 83 (see FIG. 5). The power transmission mechanism 83 may include, for example, a gear train, and a timing belt may be suitably used from the viewpoint of assembling space.

6. Control System

Figure 8:
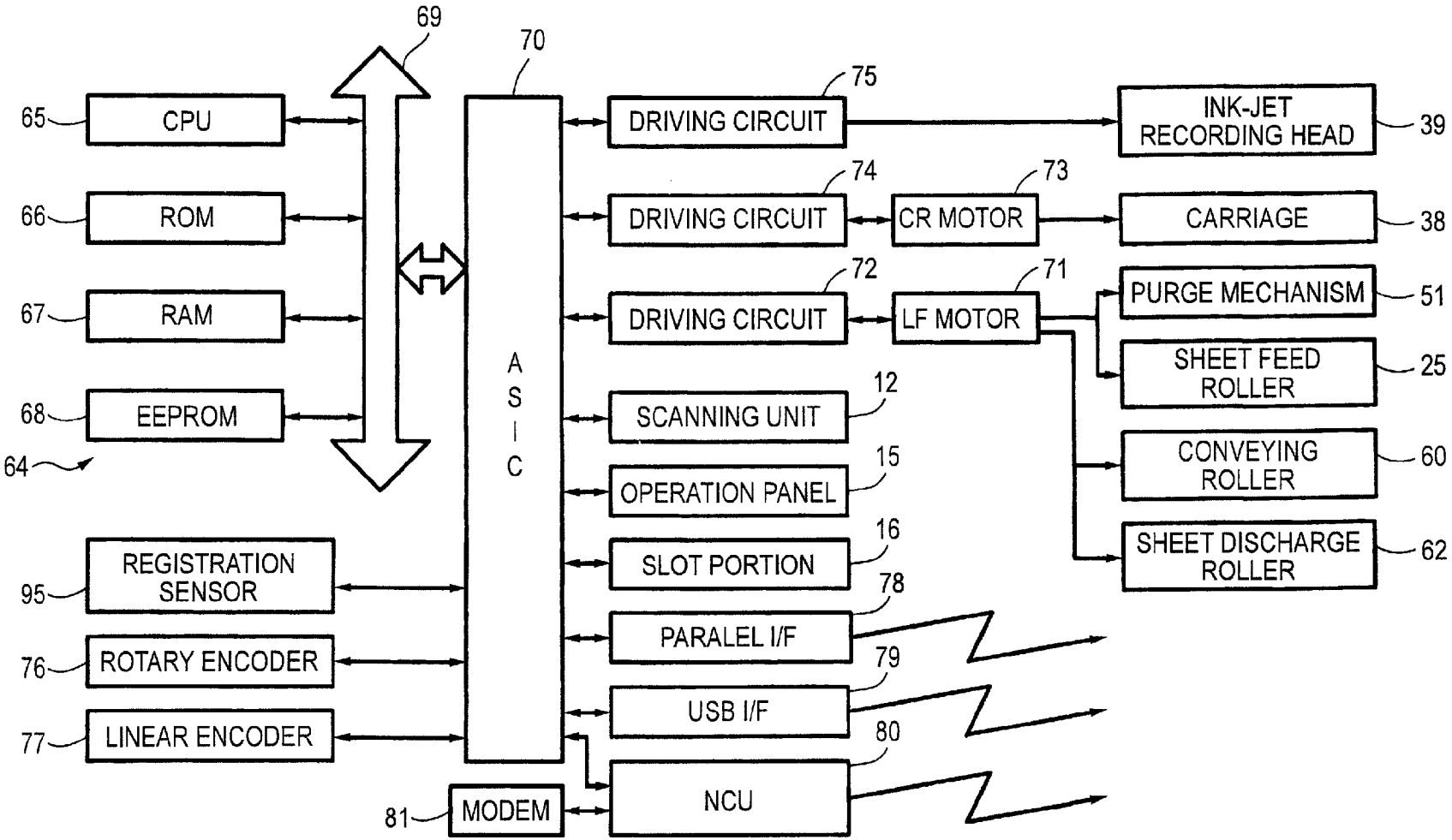
FIG. 8 is a block diagram showing the configuration of a control unit of the composite device according to one embodiment of the invention.

FIG. 8 is a block diagram showing the configuration of the control unit 64 of the composite device 10.

The control unit 64 controls the whole operation of the composite device 10 including not only the printer unit 3 but the scanner unit 2, and includes a main board connected with the flat cable 85. In addition, since the configuration on the control of the scanner unit 12 is not a main configuration of the embodiment, the detailed description thereof is omitted.

As shown in this drawing, the control unit 64 is configured as a microcomputer mainly including a CPU (Central Processing Unit) 65, a ROM (Read Only Memory) 66, a RAM (Random Access Memory) 67, and an EEPROM (Electrically Erasable and Programmable ROM) 68. The control unit 64 is connected to an ASIC (Application Specific integrated Circuit) 70 via a bus 69.

A program for controlling various operations of the composite device 10 etc. is stored in the ROM 66. The RAM 67 is used as a storage region or working area that temporarily records various data used when the CPU 65 executes the program. Further, setting, flags, etc. to be held even after power-off are stored in the EEPROM 68.

The ASIC 70 generates a phase excitation signal that applies an electric current to the LF motor 71 according to a command from the CPU 65. This signal is given to a driving circuit 72 of the LF motor 71, and a driving signal is supplied to the LF motor 71 via the driving circuit 72. In this way, rotation control of the LF motor 71 is performed.

The driving circuit 72 drives the LF motor 71 connected to the sheet feed roller 25, the conveying roller 60, the sheet discharge roller 62, and the purging mechanism 51. The driving circuit 72 receives an output signal from the ASIC 70 to form an electric signal for rotating the LF motor 71. The LF motor 71 receives this electric signal, and is thereby driven. The rotatory power of the LF motor 71 is transmitted to the sheet feed roller 25, the conveying roller 60, the sheet discharge roller 62, and the purging mechanism 51. In addition, the rotatory power of the LF motor 71 is transmitted to the sheet feed roller 25, etc. via a drive mechanism containing a gear, a driving shaft, etc. As such, in the composite device 10 according to the present embodiment, the LF motor 71 serves as a driving source of conveyance of a recording sheet located on the platen 42 or discharge of a recorded recording sheet to the sheet discharge tray 21, other than feeding of a recording sheet from the sheet feed tray 20.

The ASIC 70 generates a phase excitation signal that applies an electric current to the CR motor 73 according to a command from the CPU 65. This signal is given to a driving circuit 74 of the CR motor 73, and a driving signal is supplied to the CR motor 73 via the driving circuit 74. In this way, rotation control of the CR motor 73 is performed.

The driving circuit 74 drives the CR motor 73. The driving circuit 74 receives an output signal from the ASIC 70 to form an electric signal for rotating the CR motor 73. The CR motor 73 receives this electric signal, and is thereby driven. The rotatory power of the CR motor 73 is transmitted to the carriage 38 via the belt driving mechanism 46, and thereby, the carriage 38 reciprocates. In this way, reciprocation of the carriage 38 is controlled by the control unit 64.

The driving circuit 75 drives the ink-jet recording head 39 with predetermined timing. On the basis of a driving control sequence output from the CPU 65, the ASIC 70 generates an output signal. On the basis of this output signal, the driving circuit 75 controls driving of the ink-jet recording head 39. The driving circuit 75 is carried on the head control board. A signal output from the driving circuit 75 is transmitted to the head control board from the main board that constitutes the control unit 64 via the flat cable 85. Thereby, the ink-jet recording head 39 ejects individual color inks selectively to a recording sheet with predetermined timing.

The rotary encoder 76 that detects the rotational amount of the conveying roller 60, the linear encoder 77 that detects the position of the carriage 38, and the registration sensor 95 that detects the leading edge and trailing edge of a recording sheet are connected to the ASIC 70. The carriage 38 is moved by power-on of the composite device 10 to one ends of guide rails 43 and 44, thereby initializing the detection position by the linear encoder 77. When the carriage 38 moves on the guide rails 43 and 44 from its initial position, the optical sensor 35 provided in the carriage 38 detects the pattern of the encoder strip 50. The control unit 64 obtains the travel distance of the carriage 38 depending on the number of pulse signals based on the detection of the optical sensor 35. The control unit 64 controls the rotation of the CR motor 73 in order to control the reciprocation of the carriage 38 on the basis of this travel distance. Further, the control unit 64 obtains the position of the leading edge or trailing edge of a recording sheet on the basis of the signal of the registration sensor 95, and the amount of encoders detected by the rotary encoder 76. When the leading edge of a recording sheet arrives at a predetermined position of the platen 42, the control unit 64 controls the rotation of the LF motor 71 in order to intermittently convey the recording sheet with every predetermined linefeed width. This linefeed width is set on the basis of a resolution input as a condition for image recording.

A parallel interface 78, a USB interface 79, etc. for transmitting and receiving data with the scanner unit 12, the operation panel 15 for performing operation instructions of the composite device 10, and slot portions 16 for allowing various small-sized memory cards to be inserted thereinto, and external information apparatuses, such as a personal computer, via parallel cables or and USB cables, may be connected to the ASIC 70. Moreover, an NCU (Network Control Unit) 80 and a modem (MODEM) 81 for realizing a facsimile function may be connected to the ASIC 70.

7. Structure of Platen

Figure 9:
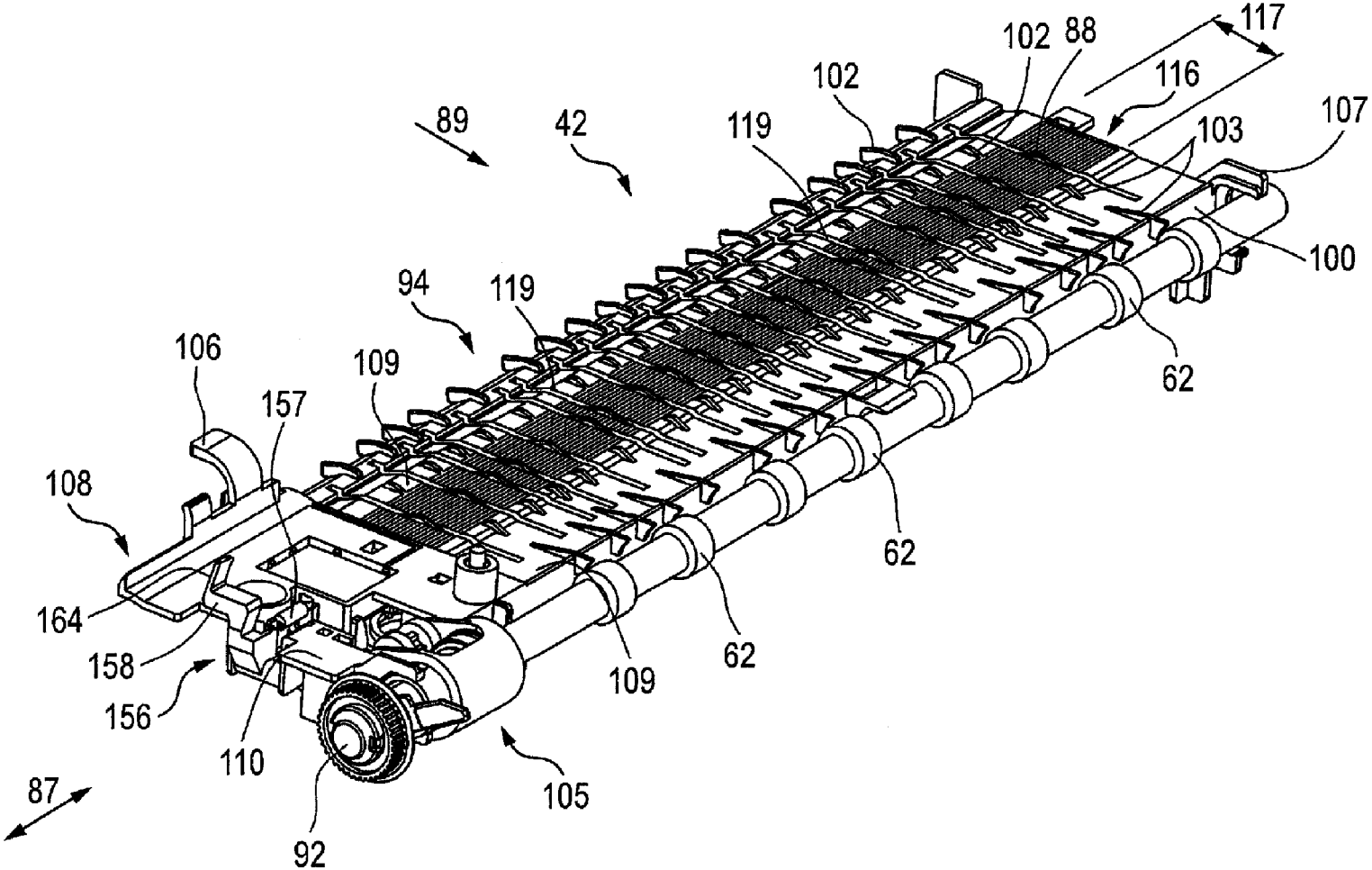
FIG. 9 is an enlarged perspective view of principal parts of FIG. 5.

FIG. 9 is an enlarged perspective view of main parts in FIG. 5, i.e., an enlarged perspective view of the platen 42.

As mentioned above, the platen 42 is disposed so as to face the ink-jet recording head 39 (lower side in FIG. 3), and supports a recording sheet conveyed. As shown in FIG. 9, the platen 42 assumes a thin-walled elongated rectangular plate shape as a whole. The platen 42 is disposed so that its longitudinal direction extends along the main scanning direction (the direction of an arrow 87). Further, in this drawing, the direction of an arrow 89 is the conveying direction. A recording sheet is conveyed in the direction of the arrow 89.

The platen 42 includes a frame 100, a first fixed rib 102 and a second fixed rib 103 that are provided in the frame 100, movable supporting member 88 slidably provided in the frame 100, and an interlocking mechanism 105 that slidingly drives the movable supporting member 88 as will be described later.

The frame 100 is made of, for example, synthetic resin or a steel plate, and forms the skeleton of the platen 42. The frame 100 is formed to have substantially C-shape in cross section. Brackets 106 and 107 are respectively provided at both ends of the frame 100 in the main scanning direction. Each of the brackets 106 and 107 is formed integrally with the frame 100. The frame 100 is fixed to the composite device 10 via the brackets 106 and 107.

A drive mechanism attaching portion 108 is provided on one end side (near side in FIG. 9) of the frame 100. The drive mechanism attaching portion 108 is formed integrally with the frame 100. The drive mechanism attaching portion 108 includes a top plate 110 that is continuous with a top surface 109 of the frame 100. Further, the plate 110 is formed in a rectangular shape as shown in this drawing, and supports the interlocking mechanism 105 to be described later in detail.

The top surface 109 of the frame 100 is provided with the first fixed rib 102 and the second fixed rib 103. Specifically, the first fixed rib 102 is provided at an upstream end 94 of the top surface 109 in the conveying direction, and protrudes upward (toward the ink-jet recording head 39). Further, the second fixed rib 103 is provided at a downstream end of the top surface 109 in the conveying direction, and protrudes upward. In the present embodiment, as shown in this drawing, the first fixed rib 102 and the second fixed rib 103 are separated from each other in the conveying direction. However, it is needless to say that the fixed ribs may be formed integrally.

In the present embodiment, a plurality of the first fixed ribs 102 are provided on the top surface 109. The first fixed ribs 102 are arranged side by side in the main scanning direction. Similarly, a plurality of the second fixed ribs 103 are provided on the top surface 109, and are arranged side by side in the main scanning direction. By arranging a plurality of first fixed ribs 102 and a plurality of second fixed ribs 103 side by side in this manner, a groove 116 is formed between the first fixed ribs 102 and the second fixed ribs 103. The groove 116 extends in the main scanning direction, and spreads in the conveying direction. The width 117 of the groove 116 corresponds to the size of the ink-jet recording head 39. Specifically, the width 117 of the groove 116 is set to be wider than an ink ejection region 118 (see FIG. 6) of the ink-jet recording head 39. As such, operation effects obtained by setting the width 117 of the groove 116 greatly will be described below.

As shown in FIG. 9, each of the first fixed ribs 102 faces each of the second fixed ribs 103 in the conveying direction (the direction of the arrow 89) across the groove 116. Further, a corner of each of the first fixed ribs 102 is chamfered, and an inclined surface is formed at the corner. In the present embodiment, inclined surfaces are formed at opposite corners of each of the first fixed ribs 102 in the conveying direction, and it is sufficient if an inclined surface is formed at least at an upstream corner of each rib in the conveying direction. Further, a corner of each of the second fixed ribs 103 is also chamfered, and an inclined surface is formed at the corner. Although each of the second fixed ribs 103 also has inclined surfaces formed at its opposite corners in the conveying direction, and it is sufficient if an inclined surface is formed at least at an upstream corner of each rib in the conveying direction. Operation effects obtained by chamfering a corner of each of the first fixed ribs 102 and a corner of each of the second fixed ribs 103 in this manner will be described below.

A plurality of slits 119 are provided in the top surface 109 of the frame 100. The slits 119 are arranged side by side in the main scanning direction at predetermined pitches. As shown in this drawing, each of the slits 119 extends along the conveying direction from the upstream end of the top surface 109 to the downstream end thereof in the conveying direction. Each of the slits 119 is formed so as to extend between an adjacent first fixed rib 102 and an adjacent second fixed rib 103. The movable supporting member 88 is fitted into the slit 119, and protruded upward through the slit 119.

8. Movable Supporting Member and Interlocking Mechanism

Figure 10:
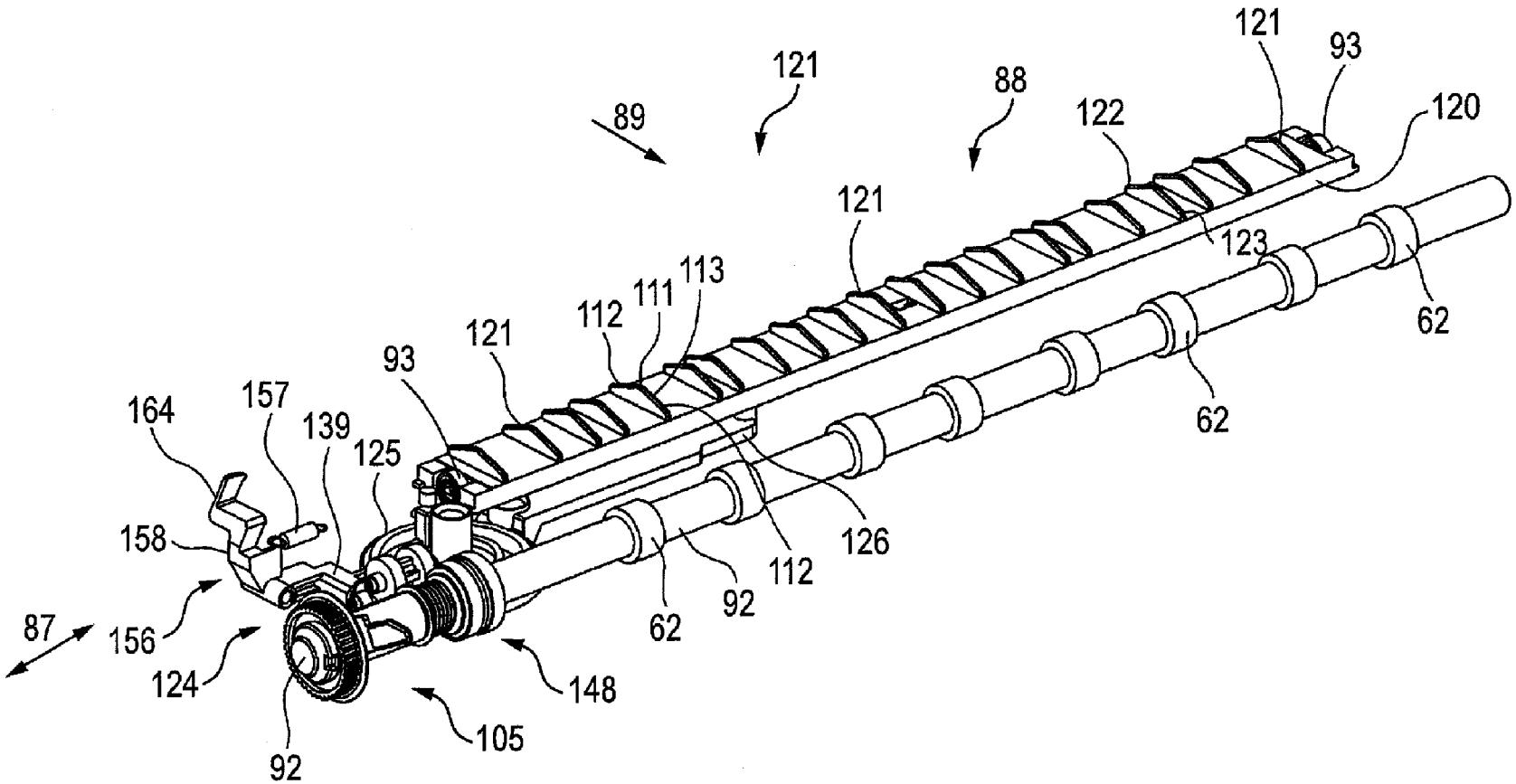
FIG. 10 is a longitudinal sectional view of a movable supporting member of the composite device according to one embodiment of the invention.
Figure 11:
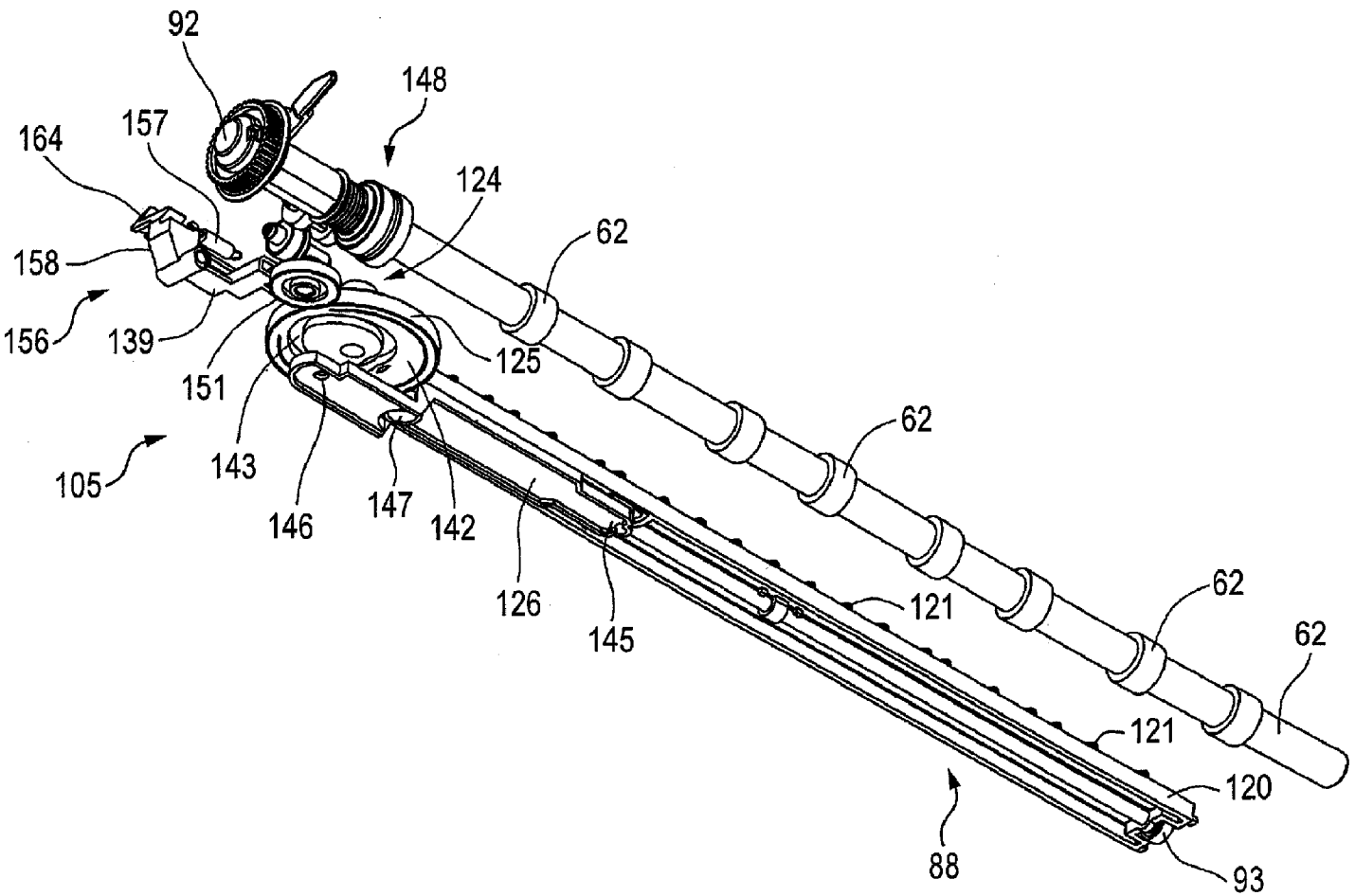
FIG. 11 is a longitudinal sectional view of a movable supporting member of the composite device according to one embodiment of the invention.
Figure 12:
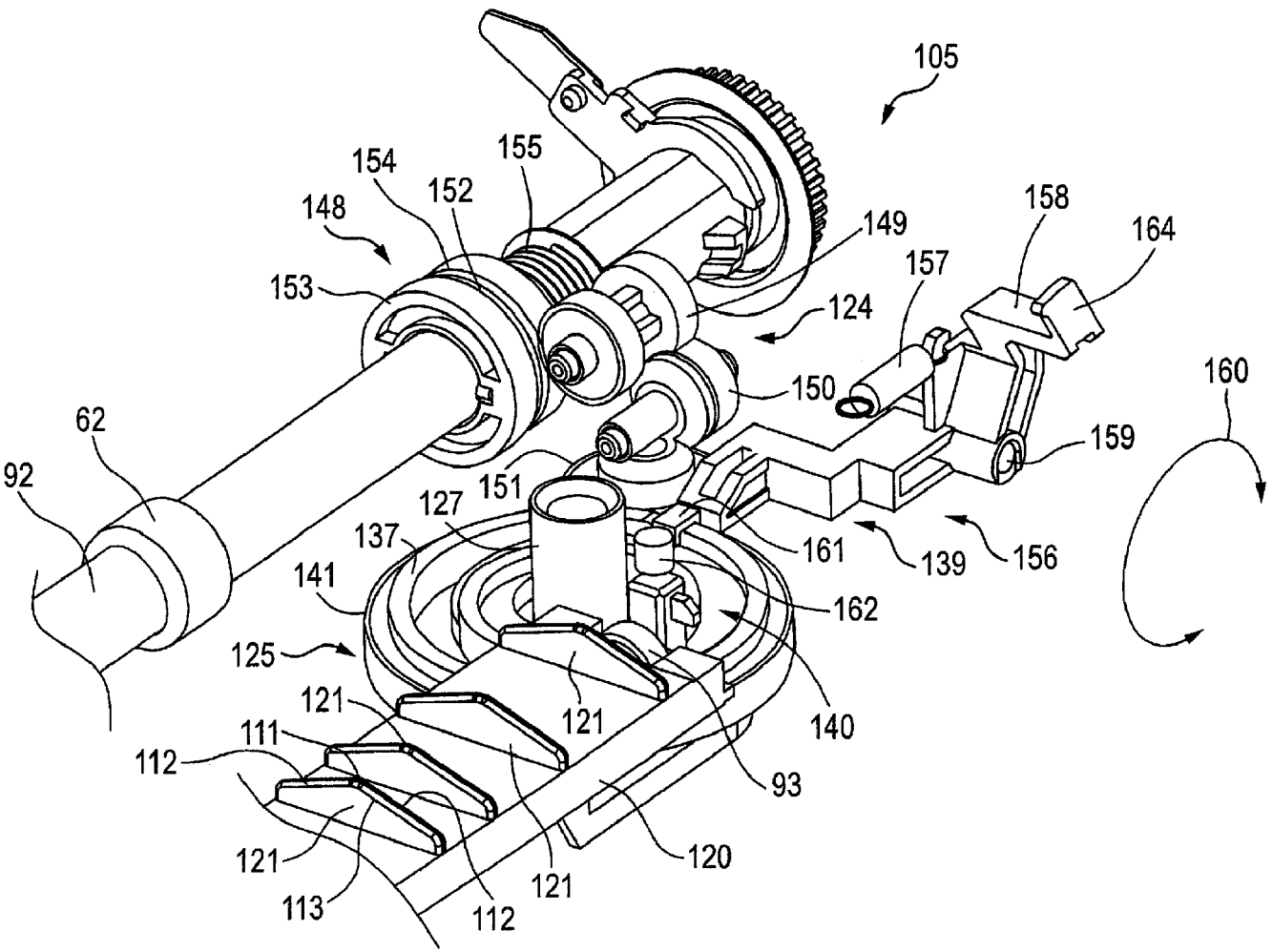
FIG. 12 is a longitudinal sectional view of an interlocking mechanism of the composite device according to one embodiment of the invention.

FIG. 10 is an enlarged perspective view of the movable supporting member 88. Further, FIG. 11 is an enlarged perspective view of the movable supporting member 88 as seen from the bottom surface of the platen 42. Moreover, FIG. 12 is an enlarged perspective view of the interlocking mechanism 105.

As shown in FIGS. 10 and 11, the movable supporting member 88 includes a base 120 formed in a box shape, and a movable rib 121 provided in the base. The movable rib 121 is formed in a thin-walled plate shape, and protrudes from the platen 42 (see FIG. 9).

The movable supporting member 88 may be made of synthetic resin or metal. Although the base 120 is formed in an elongated plate shape as a whole, and has substantially C shape in cross section. As shown in FIG. 9, the base 120 is fitted into the frame 100 from below. As shown in FIG. 10, sliding rollers 93 are provided at both ends of the base 120 in the main scanning direction. Each of the sliding rollers 93 is provided so as to be rotatable with respect to the base 120, and smoothly rolls with respect to the frame 100. Accordingly, the base 120 can be smoothly slid in the conveying direction (in the direction of the arrow 89 in FIGS. 9 and 10) inside the frame 100.

As shown in FIG. 10, the movable rib 121 is provided on the top surface of the base 120. The movable rib 121 is formed integrally with the base 120. The movable rib 121 is formed in the shape of a triangle. In the present embodiment, a plurality of the movable ribs 121 are provided on the top surface of the base 120. The movable ribs 121 are erected from the top surface of the base 120, and are arranged at predetermined intervals along the main scanning direction (the direction of the arrow 87 in FIG. 10). The predetermined intervals correspond to the pitches of the slits 119 (see FIG. 9). Accordingly, each of the movable ribs 121 is inserted through a slit 119 provided in the frame 100, and protrudes upward from the top surface 109 of the frame 100.

As mentioned above, the movable ribs 121 in the movable supporting member 88 are formed in the shape of a triangle in side view. That is, similarly to the first fixed ribs 102 and the second fixed ribs 103, corners 122 and 123 of each of the movable ribs 121 constitute inclined portions that are inclined in the conveying direction. An apex of each of the movable ribs 121 forms a contact portion 111 that contacts a recording sheet to support it. The inclined portions of each of the movable ribs 121 are continuous with the contact portion 111 and form the non-contact portion 112 that does not contact a recording sheet. In the present embodiment, the inclined portions are formed to be connected to the both corners 122 and 123 of each of the movable ribs 121 in the conveying direction, but it is sufficient if the inclined portion is formed at least at the upstream corner 122 in the conveying direction. As such, operation effects obtained by forming the movable ribs 121 in the shape of a triangle will be described below.

The interlocking mechanism 105 allows the movable supporting member 88 to slide in the conveying direction as mentioned above. The interlocking mechanism 105 is interposed between a sheet discharge roller shaft 92 and the movable supporting member 88. By providing the interlocking mechanism 105, the movable supporting member 88 interlocks with the sheet discharge roller shaft 92. The movable supporting member 88 is moved so as to follow a recording sheet so that the edges of the recording sheet conveyed over the platen 42 may always be supported. Specifically, when a recording sheet is conveyed to the upstream given position (upstream end 94 in the conveying direction in the present embodiment: see FIG. 9) of the frame 100 of the platen 42 in the conveying direction, the movable ribs 121 move to the upstream end 94 in the conveying direction so as to meet the recording sheet. Thereafter, the movable ribs 121 are stopped at the upstream end 94 in the conveying direction. The movable ribs 121 are stopped until a recording sheet conveyed overhangs each movable rib so as to cover the contact portion 111 and the upper portion 113 (in the vicinity of the contact portion 111) of the non-contact portion 112 from above. Thereafter, the movable ribs 121 slide to the downstream in the conveying direction while supporting the recording sheet with conveyance of the recording sheet. The operation of sliding of the movable supporting member 88 will be described below in detail.

As shown in FIG. 12, the interlocking mechanism 105 includes a rotating plate 125 and a lever member 126 (see FIGS. 10 and 11) that converts the rotational motion of the rotating plate 125 into the translational motion of the movable supporting member 88. The lever member 126 is disposed between the rotating plate 125 and the movable supporting member 88. The sheet discharge roller shaft 92 is a driving source of the rotating plate 125. The rotating plate 125 is rotationally driven via the power transmission mechanism 124.

Figure 13:
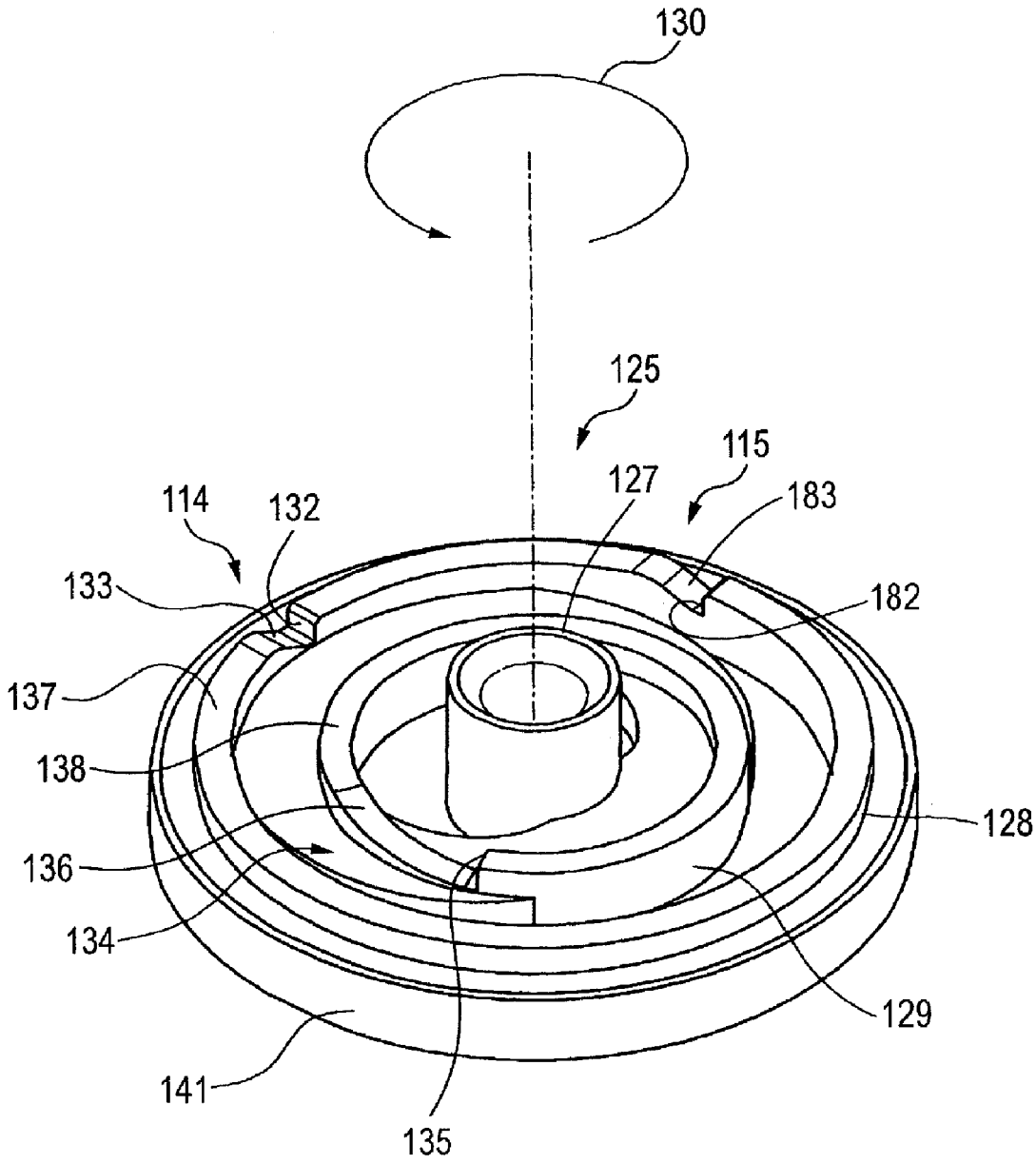
FIG. 13 is a longitudinal sectional view of a rotating plate of the composite device according to one embodiment of the invention.
Figure 14:
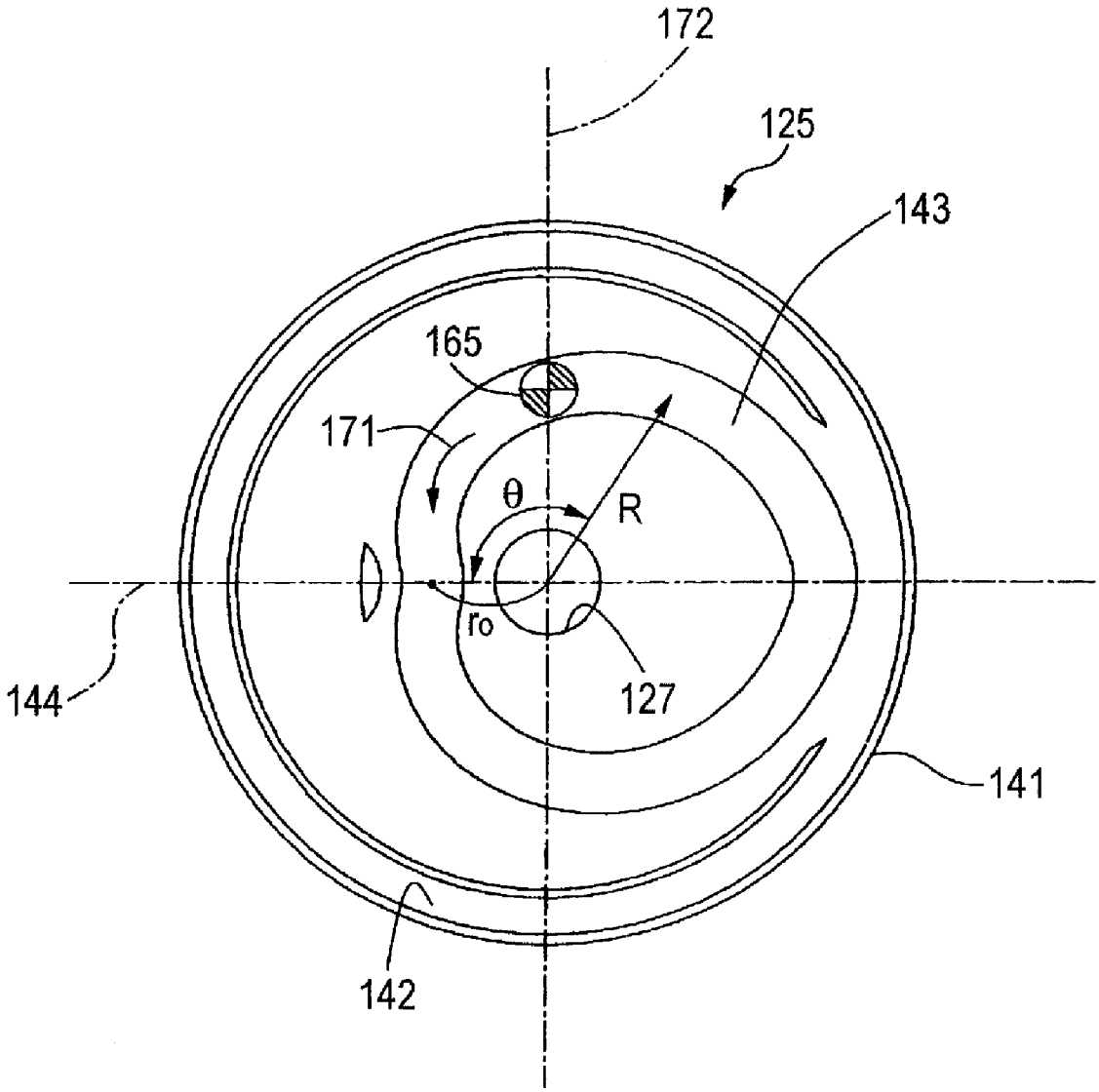
FIG. 14 is a bottom view of the rotating plate of the composite device according to one embodiment of the invention.

FIG. 13 is an enlarged perspective view of the rotating plate 125. Further, FIG. 14 is a bottom view of the rotating plate 125.

As shown in FIGS. 12 and 13, the rotating plate 125 is formed in the shape of a disc. The rotating plate 125 may be made of resin and metal. The rotating plate 125 has a circular disc portion 141 and a cylinder shaft 127 erected in the middle of the top surface of the disc portion 141. The cylinder shaft 127 is rotatably supported by the frame 100 of the platen 42. Specifically, a rotation center shaft (not shown) is erected from the frame 100, for example. In this case, the rotation center shaft extends in a direction orthogonal to both the main scanning direction and the conveying direction. The cylinder shaft 127 is rotatably fitted into the rotation center shaft. However, the cylinder shaft 127 may be directly fitted into the frame 100. Ribs 128 and 129 are erected from the top surface of the rotating plate 125. The cross-sectional shape of the rib 129 is a rectangular shape. The rib 129 is formed in an annular shape about the shaft 127. Further, the cross-sectional shape of the rib 128 is also a rectangular shape. The rib 128 is formed in an annular shape so as to surround the rib 129 about the shaft 127.

The rotating plate 125 is rotated normally or reversely as the direction of an arrow 130 as a normal rotation direction via the power transmission mechanism 124 to be described in detail. As shown in FIG. 13, a rib 128 is provided with substantially V-shaped groove 114 and groove 115. Two wall surfaces are formed by the groove 114. One wall surface is a normal rotation regulating surface 132 that extends in along the axial direction of the shaft 127, i.e., a direction orthogonal to the rotational direction of the rotating plate 125. The other wall surface is a reverse rotation allowing surface 133 that is connected to the top surface 137 of the rib 128 while extending from a lower edge of the normal rotation regulating surface 132 to the normal rotation side of the rib 128 in its circumferential direction. Further, the groove 115 is provided in a position that makes an angle of 90° (degree) with the groove 114 with the cylinder shaft 127 as a center. The groove 115 has the same shape as the groove 114, and two wall surfaces are formed by the groove 115. That is, one wall surface is a normal rotation regulating surface 182 that extends in the axial direction of the shaft 127, and the other wall surface is a reverse rotation allowing surface 183 that is connected to the top surface 137 of the rib 128, while extending from the lower edge of the normal rotation regulating surface 132 to the normal rotation side of the rib 128 in its circumferential direction. Although described below in detail, the groove 114 determines the initial position of the rotating plate 125, and the groove 115 determines a specific position where the rotating plate 125 has been rotated by 90° from the initial position.

The rib 129 is also provided with a substantially V-shaped groove 134. The groove 134 includes two wall surfaces. One wall surface is a reverse rotation regulating surface 135 that extends along the axial direction of the shaft 127, i.e., in a direction orthogonal to the rotational direction of the rotating plate 125, and the other wall surface is a normal rotation allowing surface 136 that is connected to the top surface 138 of the rib 129 while extending from a lower edge of the reverse rotation regulating surface 135 to the reverse rotation side of the rib 129 in its circumferential direction. The groove 114 and the groove 134 are engaged with a locking member 139 and a locking member 140 (see FIG. 12) serving as a rotation regulating means 156 to be described below in detail, respectively. As the locking member 139 engages the grooves 114 and 115, the normal rotation of the rotating plate 125 is regulated, and as the locking member 140 engages the groove 134, the reverse rotation of the rotating plate 125 is regulated.

As shown in FIGS. 11 and 14, a guide groove 143 serving as an engaging portion is provided in a rear surface 142 of the rotating plate 125. The guide groove 143 is formed so as to draw a predetermined locus curve. The shape of the guide groove 143 will be described in a spherical coordinate system using the center of the cylinder shaft 127 as an origin, as shown in FIG. 14. That is, assuming that an imaginary axis 144 that extends in a horizontal direction along the rear surface 142 is set in this drawing, the guide groove 143 is formed a locus curve that satisfies $R=r_0+k\theta$ (k is a constant). In this case, the angle that faces the left of the imaginary axis 144 from the origin is $\theta=0$, and the clockwise direction about the origin is a positive direction of E. This locus curve draws an Archimedean spiral. The distance R from the origin to the center of the guide groove 143 and the angle $\theta$ have a linear relationship. Here, in the present embodiment, the range of a locus curve according to $R=r_0+k\theta$ is $0° \leqq \theta \leqq 180°$, and the locus curve formed within this range is disposed so as to be laterally symmetrical (vertically symmetrical in this drawing) with respect to the imaginary axis 144. Accordingly, the guide groove 143 is formed along an Archimedean spiral that is formed so as to be vertically symmetrical with respect to the imaginary axis 144.

As shown in FIG. 11, the lever member 126 is formed in an elongated rod shape. The lever member 126 is attached to the base 120 of the movable supporting member 88. Specifically, a distal end 145 of the lever member 126 is fitted into the rear surface of the base 120, and a proximal end 146 of the lever member 126 is fitted into the guide groove 143 (see FIG. 14) of the rotating plate 125. An intermediate portion 147 of the lever member 126 is supported by the frame 100 of the platen 42. In this drawing, a supporting structure between the lever member 126 and the frame 100 of the platen 42 is not shown. However, as for this supporting structure, for example, a structure where the intermediate portion 147 is rotatably fitted into the supporting shaft (not shown) provided in the frame 100 may be adopted.

Since the proximal end 146 of the lever member 126 is fitted into the guide groove 143 of the rotating plate 125, it can be displaced only in the longitudinal direction of the guide groove 143. On the other hand, since the distal end 145 of the lever member 126 is fitted into the base 120, it can be displaced only in the sub-scanning direction that is perpendicular to the main scanning direction. For this reason, when the rotating plate 125 rotates, the proximal end 146 of the lever member 126 is guided by the guide groove 143. That is, the lever member 126 pivotable around the intermediate portion 147 as a pivotal center. Accordingly, the distal end 145 of the lever member 126 is displaced with the intermediate portion 147 as a center. When the distal end 145 is displaced in the sub-scanning direction with respect to the base 120, the base 120 slides in the conveying direction.

At this time, the amount of displacement of the distal end 145 of the lever member 126 is a predetermined multiple of the amount of displacement of the proximal end 146 of the lever member 126. Specifically, this multiplication factor corresponds to the ratio of a distance from the intermediate portion 147 to the distal end 145 and a distance from the intermediate portion 147 to the proximal end 146. Accordingly, the amount of displacement of the distal end 145 is obtained by amplifying the amount of displacement of the proximal end 146 by the predetermined multiple. That is, by providing the lever member 126, the rotational amount of the rotating plate 125 is converted into the amount of displacement of the base 120 in the conveying direction by the predetermined multiplication factor.

As shown in FIG. 12, the power transmission mechanism 124 includes a torque limiter 148 provided in the sheet discharge roller shaft 92, and gears 149 to 151. The torque limiter 148 includes a flange 153 provided in the sheet discharge roller shaft 92, a friction plate 152, a pressing plate 154, and a coil spring 155. As the friction plate 152, typically, a non-woven fabric may be adopted. The pressing plate 154 abuts on the flange 153 via the friction plate 152. The coil spring 155 resiliently urges the pressing plate 154 along with the friction plate 152 to the flange 153. When the pressing plate 154 is pushed against the flange 153 by the coil spring 155, a predetermined frictional force is generated between the pressing plate 154 and the flange 153. Power transmission is performed between the pressing plate 154 and the flange 153 by this frictional force. In other words, the torque transmitted between the pressing plate 154 and the flange 153 is restricted to a fixed level or less. If the resilient force of the coil spring 155 is set large, the torque restricted becomes large accordingly.

Although not clearly shown in this drawing, teeth are formed at an outer peripheral surface of the pressing plate 154, and the teeth mesh with the gear 149. Accordingly, when the pressing plate 154 rotates, the gear 149 also rotates. The gear 150 meshes with the gear 149, and the gear 151 meshes with the gear 150. It is noted that the rotation center shaft of the gear 150 and the rotation center shaft of the gear 151 are orthogonal to each other, and the gear 150 and the gear 151 form an umbrella gear train. As shown in FIG. 11, the outer peripheral surface of the gear 151 comes into contact with the outer peripheral surface of the rotating plate 125. In the present embodiment, torque transmission is performed by the frictional force that is generated as the gear 151 and the rotating plate 125 come into contact with each other. However, it is natural that teeth may be formed at both the gear 151 and the rotating plate 125, and both may be connected together to constitute a spur gear train.

As mentioned above, the rotation regulating means 156 that regulates the rotation of the rotating plate 125 is provided. As shown in FIG. 12, the rotation regulating means 156 includes the locking member 139 and locking member 140, a coil spring 157 serving as an elastic member, and an abutting member 158 that changes the posture of the locking member 140. The coil spring 157 resiliently urges the locking member 139 so that the locking member 139 may engage the rotating plate 125. The abutting member 158 abuts on the recording head 39 of the ink-jet recording apparatus as the ink-jet recording head 39 slides in the main scanning direction, and thereby, the posture of the locking member 140 is changed as will be described later.

The locking member 139 is formed in the shake of a crank. A proximal end of the locking member 139 is rotatably supported by a supporting shaft 159. For this reason, the locking member 139 can be elevated in the direction of an arrow 160 with the supporting shaft 159 as pivotal center. A distal end of the locking member 139 is provided with an engaging claw 161. The engaging claw 161 is formed in the shape of a wedge. The profile shape of the engaging claw 161 corresponds to the inner wall shape of the groove 114 of the rotating plate 125. Accordingly, the engaging claw 161 is adapted to fit into the groove 114. As mentioned above, the groove 115 has the same structure as the groove 114. Accordingly, the engaging claw 161 is adapted to fit even into the groove 115.

Since the locking member 139 is pivotable about the supporting shaft 159, the posture of the locking member 139 can be changed between a posture in which the locking member falls toward the rotating plate 125, and the engaging claw 161 is fitted into the groove 114 or groove 115, and a posture in which the locking member rises from the rotating plate 125 and the engaging claw 161 escapes from the groove 114 and groove 115. Here, the posture in which the engaging claw 161 is fitted into the groove 114 or groove 115 is defined as a "rotation regulation posture," and the posture in which the engaging claw 161 escapes from the groove 114 and the groove 115 is defined as a "rotation allowing posture." It is noted that, since the coil spring 157 is provided, the locking member 139 is always resiliently urged toward the rotation regulation posture.

Accordingly, even in a case where the rotating plate 125 tends to make a normal rotation in a state where the engaging claw 161 fits into the groove 114, the engaging claw 161 and the normal rotation regulating surface 132 (see FIG. 13) abut on each other in the normal rotation direction, and, as a result, the normal rotation of the rotating plate 125 is regulated. That is, the rotating plate 125 is positioned in the initial position. Further, even in a state where the engaging claw 161 fits into the groove 115, the normal rotation of the rotating plate 125 is regulated similarly. That is, the rotating plate 125 is positioned in a position (the specific position) where it has rotated by 90° from the initial position.

On the other hand, in a case where the rotating plate 125 is rotated reversely even in a state where the engaging claw 161 fits into the groove 114 or groove 115, the engaging claw 161 can slide along the reverse rotation allowing surfaces 133 and 183 (see FIG. 13). As the engaging claw 161 slides on the reverse rotation allowing surfaces 133 and 183, the locking member 139 changes toward the rotation allowing posture against the resilient force of the coil spring 157. Thereby, the engaging claw 161 arrives at the top surface 137 of the rib 128 of the rotating plate 125, and slides on the top surface 137 of the rib 128 with the rotation of the rotating plate 125.

The locking member 140 is formed in the shape of a quadrangular prism. Although not shown in FIG. 12, an engaging claw is formed at a lower end of the locking member 140. The engaging claw is formed in the shape of a wedge similarly to the engaging claw 161 of the locking member 139. The engaging claw will be fitted into the groove 134 (see FIG. 13) provided in the rib 129 of the rotating plate 125. The locking member 140 is provided so as to be vertically slidable in this drawing, and is always resiliently urged downward by the coil spring 162. That is, the engaging claw provided in the locking member 140 permits the normal rotation of the rotating plate 125 while it always engages the rotating plate 125 to regulate the reverse rotation of the rotating plate 125.

As shown in FIG. 12, the abutting member 158 is connected with the proximal end of the locking member 139. Accordingly, the abutting member 158 is rotatable along with the locking member 139 about the supporting shaft 159. A distal end 164 of the abutting member 158 is formed in the shape of an arm that extends upward. When the carriage 38 (see FIG. 5) of the ink-jet recording head 39 slides in the main scanning direction, the carriage 38 abuts on the distal end 164 of the abutting member 158. Further, the coil spring 157 is connected with the abutting member 158. Thereby, the locking member 139 is resiliently urged along with the abutting member 158 as mentioned above. Accordingly, as the carriage 38 abuts on the distal end 164 of the abutting member 158, the locking member 139 is forcibly changed to the rotation allowing posture.

9. Operation of Image Recording

Next, the operation of image recording by the composite device 10 according to the present embodiment will be described.

In the composite device 10 according to the present embodiment, the operation panel 15 (see FIG. 1) is selected so that a mode of image recording can be selected. That is, as a user operates the operation panel 15, a recording with margin or borderless recording can be selected arbitrarily. When a recording mode is set by the operation panel 15, a signal that designates a recording mode is sent to the CPU 65 from the ASIC 70 (see FIG. 8). The CPU 65 receives this signal, and issues a command for driving the CR motor 73 and the recording head 39 to the driving circuit 74 and the driving circuit 75. Specifically, in a case where setting of the borderless recording is made, the CR motor 73 is driven so as to press the carriage 38 (see FIG. 5) against the abutting member 158 (see FIG. 12).

Figure 15:
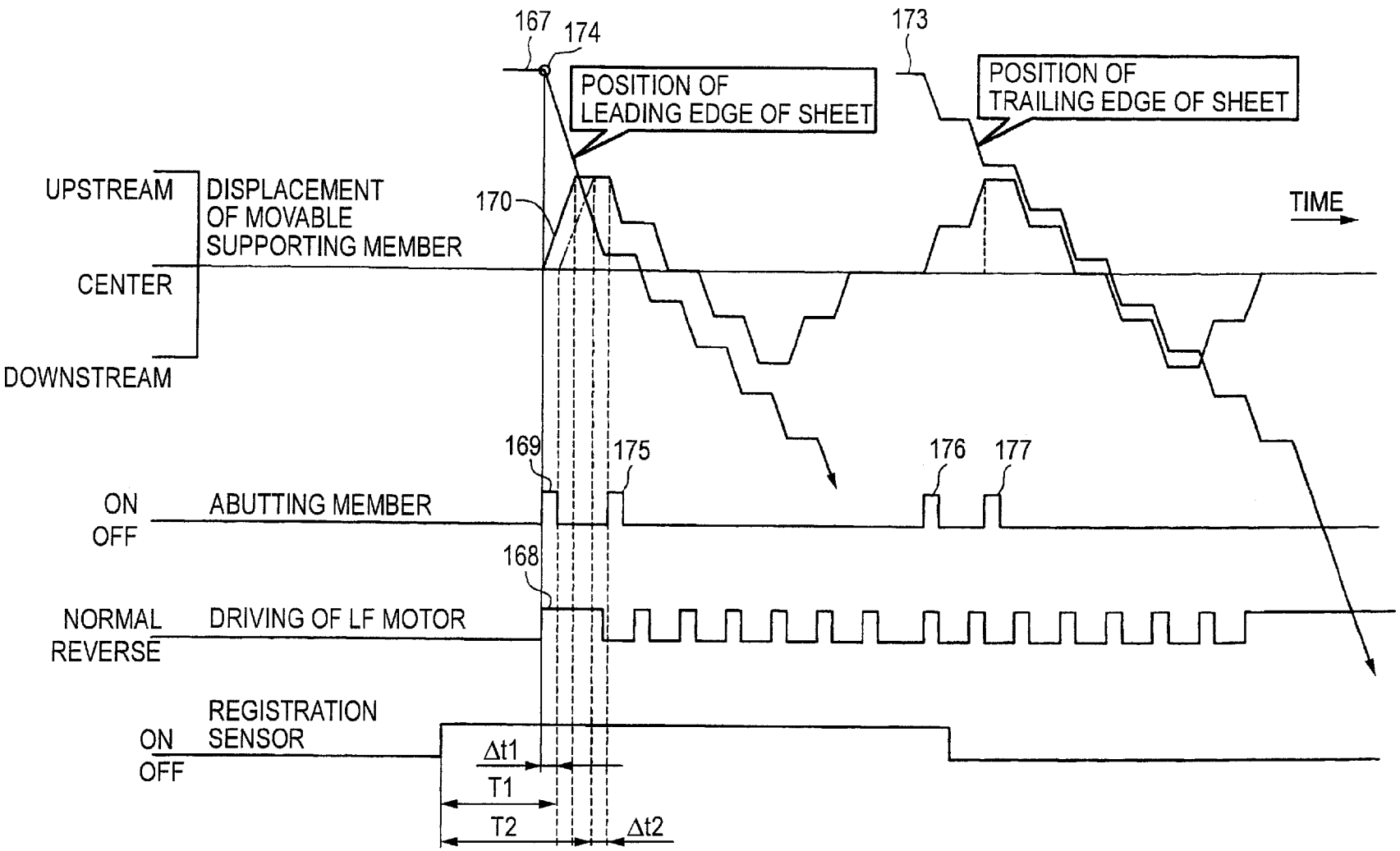
FIG. 15 is a timing chart showing conveyance of a recording sheet, and timing of sliding of the movable supporting member, when borderless recording is performed.
Figure 16A:
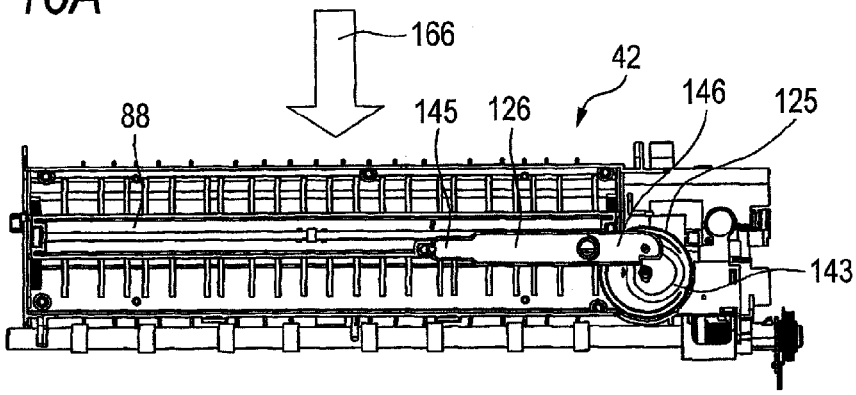
FIGS. 16A to 16D are views showing displacement of the movable supporting member during conveyance of a recording sheet, in order of 16A to 16D.
Figure 16B:
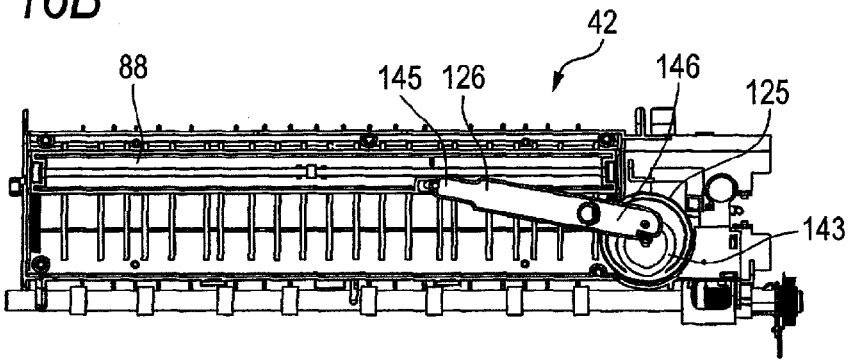
Figure 16C:
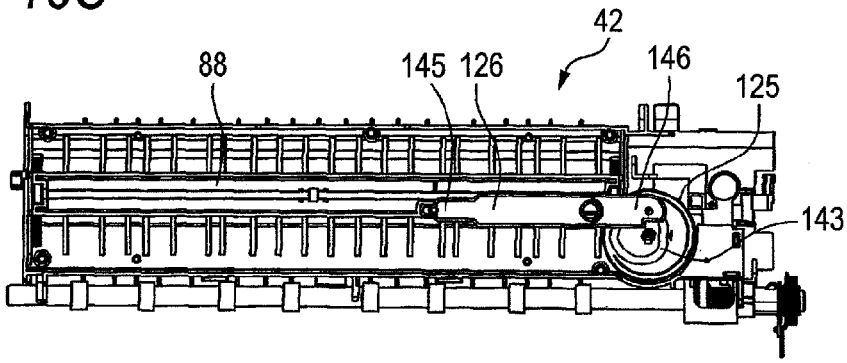
Figure 16D:
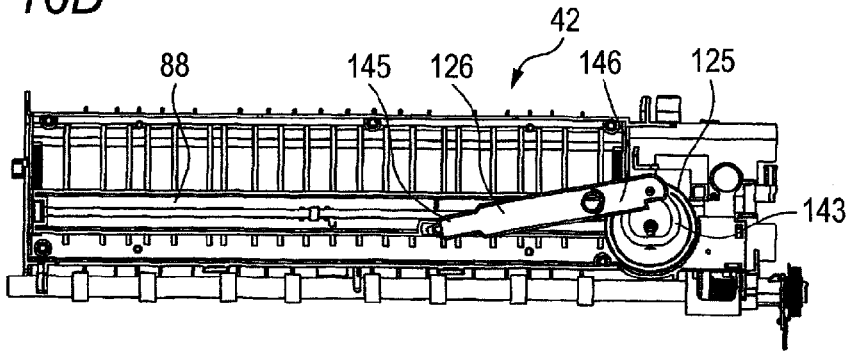
Figure 17A:
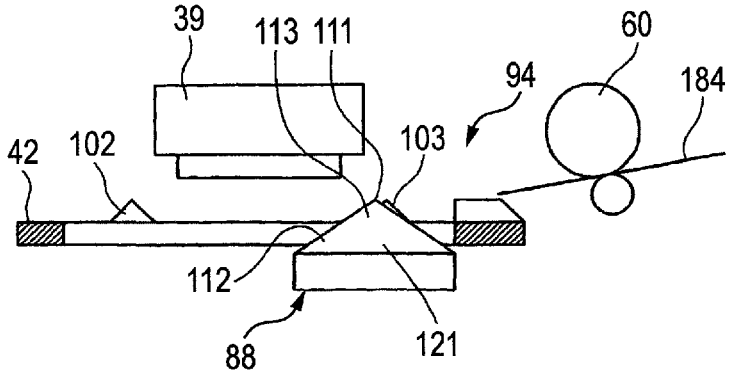
FIGS. 17A to 17C are views showing the positional relationship between a recording sheet and the movable supporting member during conveyance of the recording sheet, in order of 17A to 17C.
Figure 17B:
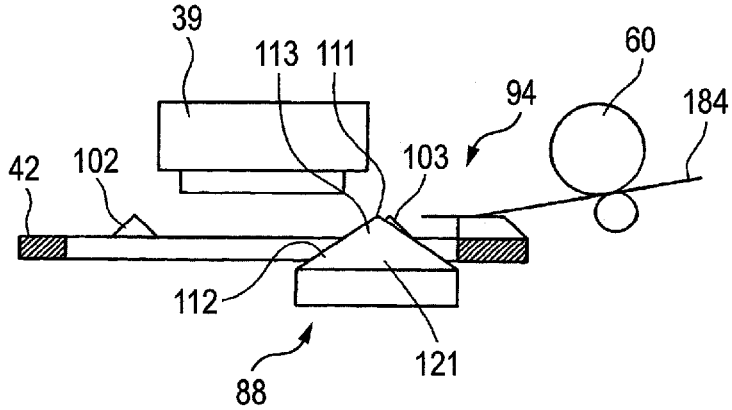
Figure 17C:
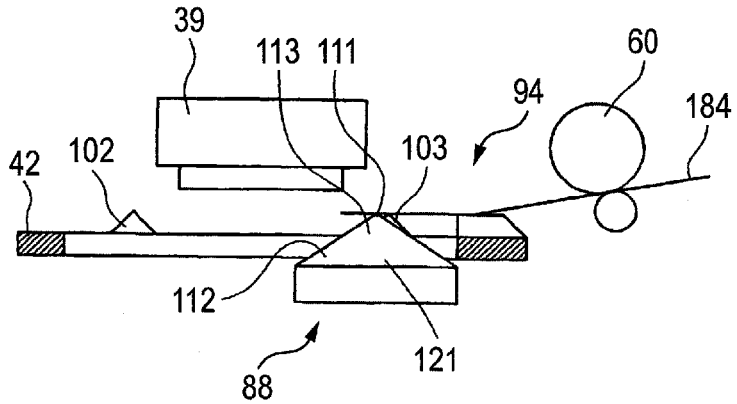

FIG. 15 is a timing chart showing conveyance of a recording sheet, and timing of sliding of the movable supporting member, when borderless recording is performed. In this drawing, the horizontal axis represents the elapse of time. Further, in this drawing, a diagram 167 and a diagram 173 show displacement of the position of the leading edge and trailing edge of a recording sheet conveyed, respectively, and a diagram 170 shows displacement of the movable supporting member 88. Moreover, in this drawing, a diagram 169 and a diagram 168 show displacement of the abutting member 158, and the driving timing of the LF motor 71, respectively. FIGS. 16A to 16D are views showing displacement of the movable supporting member 88 during conveyance of a recording sheet, in order of FIG. 16A to 16D. In this drawing, the direction of an arrow 166 is the conveying direction of a recording sheet. In addition, this drawing shows the timing of operation from when a recording sheet is registered by the conveying roller 60 (see FIG. 3) to when recording onto the recording sheet is completed. In this drawing, the operation until a recording sheet fed from the sheet feed tray 20 arrives at the conveying roller 60 is omitted. FIGS. 17A to 17C are views showing the positional relationship between a recording sheet and the movable supporting member 88 during conveyance of the recording sheet, in order of 17A to 17C.

When image recording is made, first, a recording sheet stacked in the sheet feed tray 20 is fed to the sheet conveying path 23. Specifically, the control unit 64 drives the LF motor 71, and thereby, the sheet feed roller 25 is rotated (see FIG. 3). During sheet feeding, the LF motor 71 is driven reversely, and the conveying roller 60 and the sheet discharge roller 62 are rotated in the direction opposite to the conveying direction. However, at this time, the sheet feed roller 25 is rotated in a direction in which a recording sheet is fed. A recording sheet fed to the sheet conveying path 23 from the sheet feed tray 20 is conveyed so that it may be reversed downward from below along the sheet conveying path 23. The leading edge of the recording sheet abuts on the registration sensor 95. By further conveying the recording sheet, the leading edge of the recording sheet abuts on the roller 60 and the pinch roller. Since the conveying roller 60 is rotated in the direction opposite to the conveying direction, the leading edge of the recording sheet is not nipped by the conveying roller 60 and the pinch roller. The leading edge of the recording sheet is registered in a state where it abuts on the conveying roller 60 and the pinch roller. The position of the leading edge of the recording sheet in this state is shown as a registration position 174 in FIG. 15. The control unit 64 drives the LF motor 71 normally after the registration of the recording sheet. Thereby, the registered recording sheet is nipped by the conveying roller 60 and the pinch roller, and the recording sheet is conveyed on the platen 42 as shown by the diagram 167 in this drawing.

By reversely driving the LF motor 71 as mentioned above, the sheet discharge roller 62 is rotated in the direction opposite to the conveying direction. As shown in FIG. 12, the reverse rotation of the LF motor 71 is transmitted to the rotating plate 125 via the driving transmission mechanism 124. As shown in this drawing, the locking member 140 always fit into the groove 134 (see FIG. 13) of the rotating plate 125. In this state, the locking member 139 fits into the groove 114 of the rotating plate 125, and the rotating plate 125 is positioned in its initial position. When the rotating plate 125 is in its initial position, the recording sheet is in the registration position 174. In this state, the normal rotation and reverse rotation of the rotating plate 125 are regulated.

Accordingly, in a state where the reverse rotation of the rotating plate 125 is regulated by the torque limiter 148 until the recording sheet is registered, only the sheet discharge roller shaft 92 is rotated reversely. In addition, if the rotating plate 125 is not in its initial position when a recording sheet is fed, the locking member 140 will not engage the groove 134. Therefore, the rotation of the sheet discharge roller 62 is transmitted to the rotating plate 125 by the driving transmission mechanism 124, and thereby, the rotating plate 125 is rotated reversely. When the rotating plate 125 is reversely rotated to its initial position, the locking member 140 engages the groove 134, the reverse rotation of the rotating plate 125 is regulated as mentioned above, and only the sheet discharge roller shaft 92 is rotated reversely. Such reverse driving of such an LF motor 71 may be set so as to be performed the time of power-on of the composite device 10 or after release of an error, as an operation for allowing the rotating plate 125 to be initialized to its initial position.

In a case where borderless recording is performed, conveyance of a recording sheet is slid so as to follow the movable supporting member 88. More specifically, when a recording sheet is disposed in the registration position 174 (see FIG. 15), as shown in FIG. 16A, the movable supporting member 88 is located in the middle of the platen 42, and the proximal end 146 of the lever member 126 is disposed in a given position of the guide groove 143 of the rotating plate 125. The given position of the guide groove 143 is a given position shown by reference numeral 165 in FIG. 14. In addition, in other words, the given position shown by the reference numeral 165 is a position where an imaginary axis 172 orthogonal to an imaginary axis 144 through the center of the cylinder shaft 127 perpendicularly intersects the guide groove 143. The relative positional relationship among the movable supporting member 88, rotating plate 125, and lever member 126 in FIG. 16A is an initial position of each of the members corresponding to the initial position of the rotating plate 125.

As mentioned above, after the leading edge of a recording sheet is registered on the basis of the conveying roller 60, as shown in the diagram 168 of FIG. 15, the LF motor 71 is intermittently driven normally. Thereby, the recording sheet is conveyed to the recording position on the platen 42. It is noted that, when a recording sheet is conveyed to its recording position, as shown in the diagram 169, the CR motor 73 is driven with predetermined timing. This predetermined timing may be synchronized with, for example, the normal rotation of the LF motor 71. Thereby, the carriage 38 (see FIG. 5) slides in the main scanning direction, and abuts on the abutting member 158 (see FIG. 12) of the rotation regulating means 156. The control of the amount of sliding of the carriage 38, i.e., the driving control of the CR motor 73 at this time is performed by the control unit 64.

When the abutting member 158 is pushed in the main scanning direction by the carriage 38 as shown in FIG. 12 ("ON" in FIG. 15), the locking member 139 rotates about the supporting shaft 159, and takes a rotation allowing posture. That is, the engaging claw 161 is disengaged from the rotating plate 125, and the normal rotation (the clockwise rotation of the rotating plate 125 about the cylinder shaft 127) becomes possible. As mentioned above, when the sheet discharge roller shaft 92 is rotated in the conveying direction by the LF motor 71, this rotation is transmitted to the rotating plate 125 via the power transmission mechanism 124, and thereby, the rotating plate 125 makes normal rotation. As a result, the movable supporting member 88 is displaced as shown in the diagram 170 of FIG. 15, and the relative positional relationship among the movable supporting member 88, the rotating plate 125, and the lever member 126 changes to FIG. 16A to FIG. 16B.

When the rotating plate 125 rotates, the engaging claw 161 slides on the top surface 137 of the rib 128. Since the rib 128 includes the groove 115, the engaging claw 161 fits into the groove 115 when the rotating plate 125 rotate by 90°. Thereby, the normal rotation of the rotating plate 125 is regulated again. At this time, as shown in FIG. 16B, the lever member 126 is pivotable and the movable supporting member 88 moves to the upstream side in the conveying direction. Specifically, before a registered recording sheet arrives at the upstream end 94 (see FIG. 9) in the conveying direction, the movable ribs 121 move to the upstream end 94 in the conveying direction, and are stopped there to meet a recording sheet conveyed. In the present embodiment, as shown in FIG. 17A, the movable ribs 121 is disposed at the upstream end 94 in the conveying direction ahead of the recording sheet 184.

After the movable ribs 121 are at the upstream end 94 in the conveying direction, as shown in the diagram 168 (see FIG. 15), the registered recording sheet 184 is further conveyed in the conveying direction. At this time, since the movable ribs 121 remain being stopped at the upstream end 94 in the conveying direction, the recording sheet 184 overhang the movable supporting member 88. Specifically, as shown in FIGS. 17B and 17C, the recording sheet 184 covers a contact portion 111 of a movable rib 121 and an upper portion 113 of a non-contact portion 112 of the movable rib from above.

Thereafter, as shown in a diagram 175 (see FIG. 15) the CR motor 73 is driven with predetermined timing. Thereby, the carriage 38 (see FIG. 5) slides in the main scanning direction, and abuts on the abutting member 158 (see FIG. 12) of the rotation regulating means 156. The control of the amount of sliding of the carriage 38, i.e., the driving control of the CR motor 73 at this time is performed by the control unit 64. In the present embodiment, the time difference between the timing shown in the diagram 169, and the timing shown in the diagram 175 is set to 2 seconds. In addition, a certain time difference may be suitably set according to the kind of a recording sheet, etc.

When the abutting member 158 is pushed again in the main scanning direction by the carriage 38 as shown in FIG. 12 ("ON" in FIG. 15), similarly to the above, the locking member 139 rotates about the supporting shaft 159, and takes a rotation allowing posture. That is, the engaging claw 161 is disengaged from the rotating plate 125, and the normal rotation (the clockwise rotation of the rotating plate 125 about the cylinder shaft 127) becomes possible. When the sheet discharge roller shaft 92 is rotated in the conveying direction by the LF motor 71, this rotation is transmitted to the rotating plate 125 via the power transmission mechanism 124, and thereby, the rotating plate 125 makes normal rotation. As a result, the movable supporting member 88 is displaced as shown in the diagram 170 of FIG. 15, and the relative positional relationship among the movable supporting member 88, the rotating plate 125, and the lever member 126 changes in order of FIGS. 16A to 16D. Hereinafter, the movement of the movable supporting member 88 will be further described in detail.

The movable supporting member 88 is initially located between the first fixed ribs 102 and the second fixed ribs 103 (see FIG. 9 and FIGS. 16A to 16D). As shown in the diagram 170 in FIG. 15, when a recording sheet is conveyed at the upstream end 94 of the frame 100 of the platen 42 in the conveying direction, the movable supporting member 88 moves to the upstream side in the conveying direction, thereby meeting the recording sheet 184. Specifically, the conveying roller 60 is rotated in the conveying direction by the normal rotation of the LF motor 71, thereby feeding a recording sheet to the platen 42, and the normal rotation of the LF motor 71 is drivingly transmitted, thereby performing the normal rotation of the rotating plate 125. The rotational direction of the rotating plate 125 at this time is the clockwise direction in FIG. 14 and FIGS. 16A to 16D. When the rotating plate 125 makes normal rotation, the proximal end 146 of the lever member 126 relatively moves in the direction of an arrow 171 from the given position 165 in FIG. 14. That is, the distance between the given position 165 of the proximal end 146 and the cylinder shaft 127 becomes small gradually with the rotation of the rotating plate 125. Accordingly, as shown in FIG. 16B, the lever member 126 pivotable around the intermediate portion 147 as a pivotal center, and as a result, the movable supporting member 88 moves to the upstream side in the conveying direction. When the angle of rotation of the rotating plate 125 amounts to 90°, the movable supporting member 88 arrives at a position where it has entered a space between adjacent first fixed ribs 102. That is, the movable ribs 121 are disposed at the upstream end 94 in the conveying direction, thereby meeting the recording sheet 184. In the present embodiment, as FIG. 15 and FIGS. 17A to 17C, the movable supporting member 88 moves to the upstream end 94 in the conveying direction before the leading edge of the recording sheet 184 arrives at the upstream end 94 of the platen 42 in the conveying direction. Therefore, the contact portion 111 of the movable rib 121 and the upper portion 113 of the non-contact portion 112 of the movable rib will be covered with the recording sheet 184 from above.

Then, as shown in FIG. 15, ejection of ink droplets by the sliding of the carriage 38 and conveyance of a recording sheet with every predetermined linefeed width corresponding to a set resolution are repeated alternately, thereby keeping on recording of an image to the recording sheet 184. That is, as shown in the diagram 168, the LF motor 71 is intermittently driven normally, and the recording sheet 184 is intermittently fed with every predetermined linefeed width. Since the rotating plate 125 is rotated in association with the driving of the LF motor 71, the recording sheet 184 is intermittently fed as mentioned above, and thereby, the rotating plate 125 is also intermittently rotated at every predetermined angle of rotation in association with this. The position 165 of the proximal end 146 of the lever member 126 moves further in the direction of the arrow 171 in FIG. 14. When the angle of rotation of the rotating plate 125 amounts to 360°, the rotating plate 125 returns to its initial position.

Within a range in which the angle of rotation of the rotating plate 125 is 90° or more to 270° or less, the distance between the given position 165 of the proximal end 146 and the cylinder shaft 127 becomes small gradually with the rotation of the rotating plate 125. Accordingly, as shown in FIGS. 16B to 16D, the lever member 126 pivotable around the intermediate portion 147 as a pivotal center, and as a result, the movable supporting member 88 moves to the downstream side in the conveying direction. When the angle of rotation of the rotating plate 125 amounts to 270°, the movable supporting member 88 is disposed at a position where it has entered a space between adjacent second fixed ribs 103. As the rotating plate 125 rotates further, the distance between the position 165 of the proximal end 146 and the cylinder shaft 127 becomes small gradually with the rotation of the rotating plate 125. For this reason, the lever member 126 is pivotable around the intermediate portion 147 as a pivotal center, and as a result, the movable supporting member 88 moves to the upstream side in the conveying direction. When the angle of rotation of the rotating plate 125 amounts to 360°, the movable supporting member 88 returns to a position corresponding to the initial position of the rotating plate 125.

As shown in FIG. 12, while the rotating plate 125 rotates, the engaging claw 161 slides on the top surface 137 of the rib 128. Accordingly, when the angle of rotation of the rotating plate 125 amounts to 360°, the engaging claw 161 urged by the coil spring 157 is again fitted into the groove 114 (see FIG. 13) of the rotating plate 125, thereby regulating the normal rotation of the rotating plate 125. In a case where the normal rotation of the rotating plate 125 is regulated, the power transmission mechanism 124 is stopped. However, since the torque limiter 148 is provided, the driving force of the LF motor 71 is transmitted to the conveying roller 60 and the sheet discharge roller shaft 92. Accordingly, smooth conveyance of the recording sheet 184 is ensured.

In a state where smooth conveyance of the recording sheet 184 is ensured, recording of an image to the recording sheet 184 is continued. At this time, as shown in the diagram 170 in this drawing, the movable supporting member 88 is stopped. However, as shown in the diagram 173, the trailing edge of the recording sheet 184 approaches the upstream end 94 of the platen 42 in the conveying direction with the conveyance of the recording sheet. The trailing edge of the recording sheet 184 is detected by the registration sensor 95. On the basis of a certain detection signal, the control unit 64 performs driving control of the CR motor 73, and thereby, the carriage 38 slides in the main scanning direction to abut on the abutting member 158 (see FIG. 12) ("ON" of FIG. 15) as shown in a diagram 176 of FIG. 15.

When the abutting member 158 is pushed in the main scanning direction by the carriage 38, the locking member 139 rotates about the supporting shaft 159, and the engaging claw 161 is disengaged from the rotating plate 125. This allows the normal rotation (clockwise rotation of the rotating plate 125 about the cylinder shaft 127). As a result, the movable supporting member 88 is displaced as shown in the diagram 170 of FIG. 15, and the relative positional relationship among the movable supporting member 88, the rotating plate 125, and the lever member 126 again changes in order of FIGS. 16B to 16D. That is, before the trailing edge of the recording sheet 184 arrives at the upstream end 94 of the platen 42 in the conveying direction, the movable supporting member 88 is intermittently moved to the upstream end 94 in the conveying direction by intermittent driving of the LF motor 71.

Similarly when the movable supporting member 88 meets the leading edge of the recording sheet 184 when the movable supporting member 88 moves to FIGS. 16A to 16B, the engaging claw 161 engages the rotating plate 125, and the movable supporting member 88 is again stopped. Even at this time, the movable ribs 121 of the movable supporting member 88 are covered from above with the recording sheet 184 conveyed. As mentioned above, in the present embodiment, the stopping time of the movable supporting member 88 is set to 2 seconds. After this stopping time has lapsed, as shown in the diagram 177 of FIG. 15, the carriage 38 abuts on the abutting member 158. Thereby, the engaging claw 161 is disengaged from the rotating plate 125, and the rotating plate 125 rotates normally (the clockwise rotation about the cylinder shaft 127). As a result, the movable supporting member 88 is displaced as shown in the diagram 170 of FIG. 15, and the relative positional relationship among the movable supporting member 88, the rotating plate 125, and the lever member 126 changes again in order of FIGS. 16B to 16D.

Then, ejection of ink droplets and conveyance of a recording sheet 184 with every predetermined linefeed width corresponding to a set resolution are repeated alternately, thereby keeping on recording of an image to the recording sheet 184. Since the rotating plate 125 is rotated in association with the driving of the LF motor 71, the LF motor 71 is intermittently driven as mentioned above, and thereby, the rotating plate 125 is also intermittently rotated at every predetermined angle of rotation in association with this. In this state, the movable ribs 121 slide to the downstream side in the conveying direction, with the recording sheet 184 supported.

When the rotating plate 125 makes one rotation, the engaging claw 161 urged again by the coil spring 157 is fitted into the groove 114 (see FIG. 13) of the rotating plate 125, thereby regulating the normal rotation of the rotating plate 125, and the movable supporting member 88 and the lever member 126 return to their positions corresponding to the initial position of the rotating plate 125. Then, when recording of an image to the recording sheet 184 is completed, the LF motor 71 is continuously driven normally, and the recording sheet 184 is discharged to the sheet discharge tray 21 (see FIG. 3). In addition, at this time, although the rotation of the rotating plate 125 is regulated, the sheet discharge roller 62 is smoothly rotated by the torque limiter 148 (see FIG. 12).

In addition, by operating the operation panel 15, the mode of image recording may be set to recording with an edge. In the recording with an edge, the movable supporting member 88 needs to move so as to follow the recording sheet 184. Accordingly, the carriage 38 does no abut on the abutting member 158, and the rotating plate 125 remains at its initial position. Since the movable supporting member 88 is always disposed in the middle of the platen, good recording with an edge is also realized. In addition, even in a case where the recording with an edge is performed, it is preferable to make reverse rotation of the LF motor 71 prior to sheet feeding. In this case, as mentioned above, even if the locking member 140 does not engage the rotating plate 125, the rotating plate 125 makes reverse rotation, whereby the locking member 140 necessarily fits into the groove 134 of the rotating plate 125, thereby performing reliable initialization.

10. Advantages of Composite Device According to Present Embodiment

In the composite device 10 according to the present embodiment, the recording sheet 184 conveyed on the platen 42 is supported by the platen 42, and ink droplets are ejected while the ink-jet recording head 39 is slid in the main scanning direction, thereby recording an image on the recording sheet 184. Although the recording sheet 184 is further conveyed with image recording in the conveying direction, since the movable supporting member 88 slides in the conveying direction while supporting the recording sheet 184 as shown in FIG. 15 and FIGS. 17A to 17C, the edges of the recording sheet 184 are always supported by the movable ribs 121 during image recording. Accordingly, the recording sheet 184 is not flexed in the conveying direction, and even if the groove 116 (see FIG. 9) is formed between the first fixed ribs 102 and the second fixed ribs 103 as in the present embodiment, the recording sheet 184 does not sag toward the groove 116. As a result, the distance between the recording sheet 184 and the ink-jet recording head 39 is kept constant, thereby realizing high-definition printing. Moreover, since the LF motor 71 is slid with the movable supporting member 88 as a driving source, there is an advantage that the movable supporting member 88 is slid smoothly.

As shown in FIG. 15 and FIGS. 17A to 17C, the recording sheet 184 is once stopped at the upstream end 94 in the conveying direction, and overhangs the movable supporting member 88. The upstream end 94 in the conveying direction is a position outside a printing region on the platen 42 (see FIG. 9). That is, ink droplets ejected from the ink-jet recording head 39 cannot arrive at the upstream end 94 in the conveying direction.

The recording sheet 184 may be conveyed earlier than preset regular timing by predetermined time, or may be conveyed later than preset regular timing by predetermined time. Here, the "regular timing" is the sliding initiation timing T1 of the movable supporting member 88 and the return timing T2 of the movable supporting member at the upstream end in the conveying direction, which is set in a conventional ink-jet recording apparatus. The regular timing T1 or T2 is based on when the recording sheet 184 conveyed turns on the registration sensor 95 (see FIG. 3). Supposing that the conveyance of the recording sheet 184 does not become relatively earlier or later than the regular timing T1 or T2, when the ink-jet recording head 39 ejects ink droplets, the contact portion 111 of the movable supporting member 88 and the upper portion 113 of the non-contact portion 112 thereof are covered with the recording sheet 184.

Figure 18:
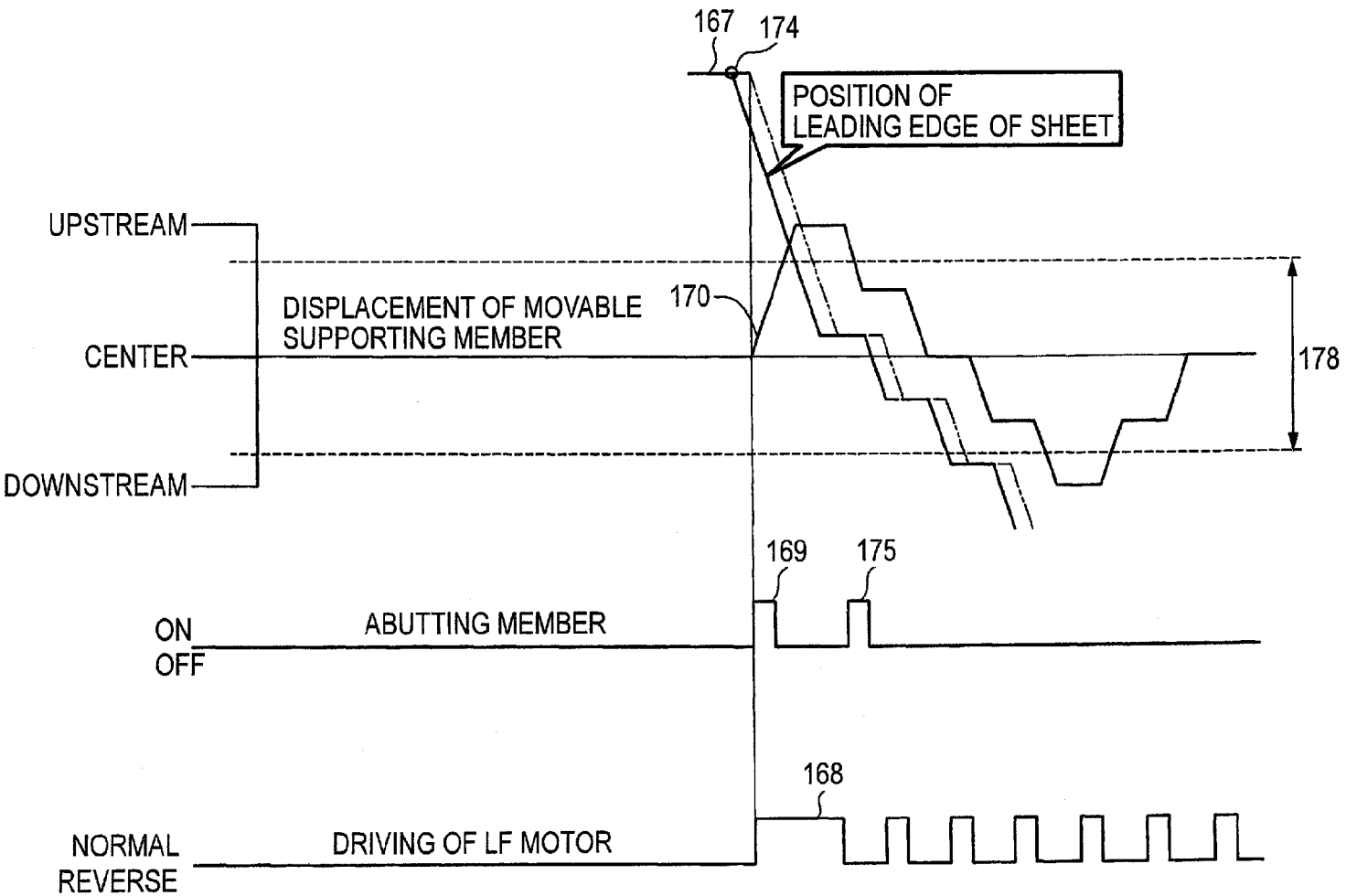
FIG. 18 is a timing chart showing conveyance of a recording sheet, and timing of sliding of the movable supporting member, when the conveyance of the recording sheet is delayed.
Figure 19:
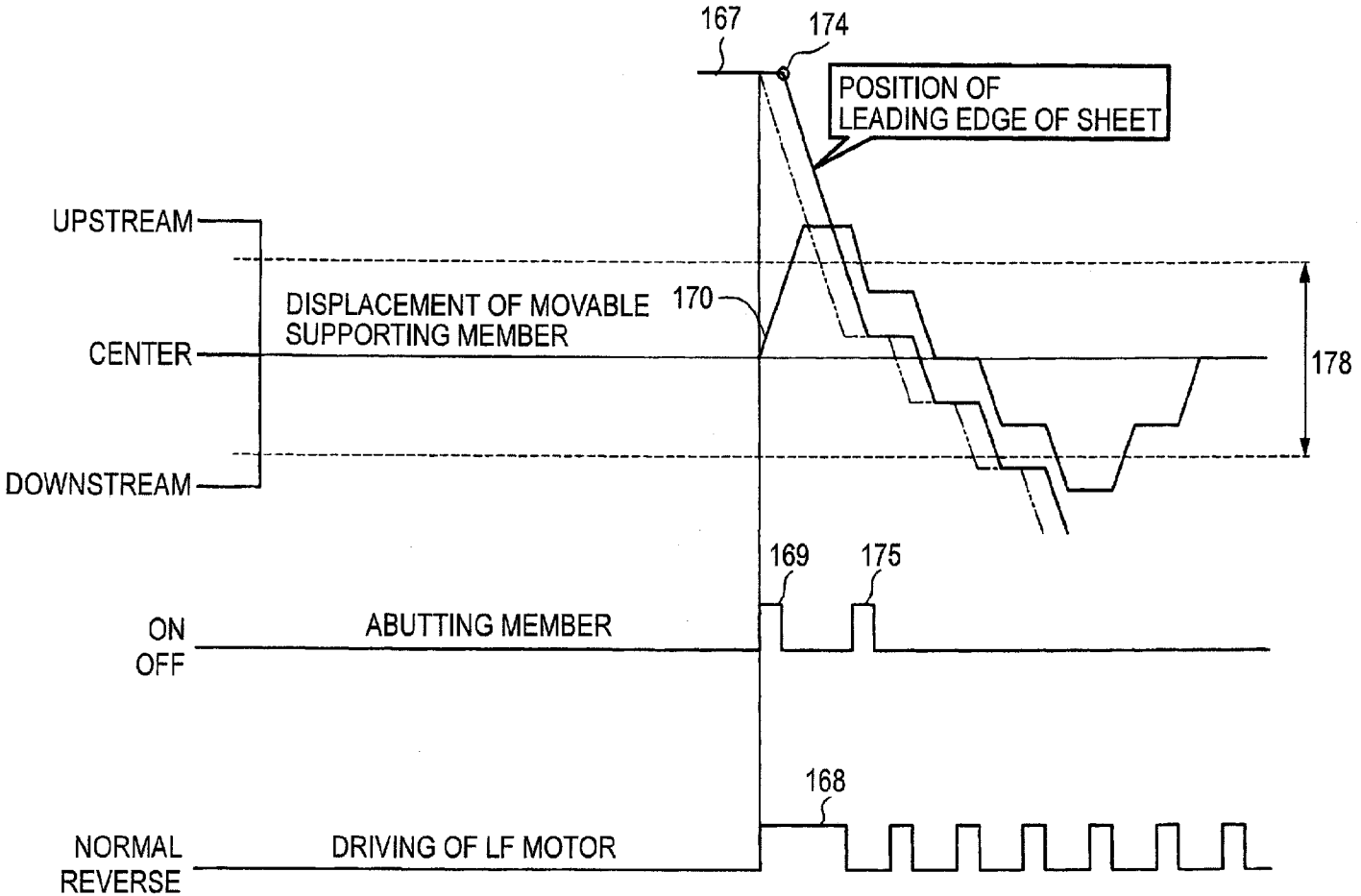
FIG. 19 is a timing chart showing conveyance of a recording sheet, and timing of sliding of the movable supporting member, when the conveyance of the recording sheet is early.

FIG. 18 is a timing chart showing conveyance of the recording sheet 184, and timing of sliding of the movable supporting member 88, when the conveyance of the recording sheet 184 is early. Further, FIG. 19 is a timing chart showing conveyance of the recording sheet 184, and timing of sliding of the movable supporting member 88, when the conveyance of the recording sheet 184 is late.

In the present embodiment, a case where the conveyance of the recording sheet 184 is relatively earlier than the regular timing T1 is assumed. As shown in FIG. 15, the movable supporting member 88 starts movement with the timing of a time (T1−Δt1). For this reason, as shown in FIG. 18, even in a case where the conveyance of the recording sheet 184 becomes relatively early in actuality, the movable supporting member 88 moves early by a time Δt1 to the upstream end 94 in the conveying direction. That is, the movable supporting member 88 retreats to the outside of a printing region 178. Accordingly, even if the ink-jet recording head 39 ejects ink droplets early in response to the conveyance of the recording sheet 184, the ink droplets ejected from the ink-jet recording head 39 do not adhere to the contact portion 111 of the movable supporting member 88 and the upper portion 113 of the non-contact portion 112 thereof.

However, in the present embodiment, actually, the recording sheet 184 may be conveyed in synchronization with the regular timing T1, or may be conveyed later than the regular timing T1 in some cases. However, even in such a case, the movable supporting member 88 has already moved to the upstream end 94 in the conveying direction at a point of time of the timing (T1−Δt1). Accordingly, even if the leading edge of the recording sheet 184 enters the printing region 178, and the ink-jet recording head 39 ejects ink droplets according to this, the ink droplets ejected from the ink-jet recording head 39 do not adhere to the contact portion 111 of the movable supporting member 88 and the upper portion 113 of the non-contact portion 112 thereof.

Moreover, the movable supporting member 88 that has arrived at the upstream end 94 in the conveying direction is once stopped at the upstream end 94 in the conveying direction, and the timing with which the movable supporting member begins to move again is measured. Specifically, the movable supporting member 88 begins to move again with the timing of a time (T2+Δt2). That is, as shown in FIG. 19, the movable supporting member 88 in the upstream end 94 in the conveying direction does not return immediately after arriving at the upstream end 94 in the conveying direction unlike a conventional technique, but the movable supporting member begins to move again after being delayed by the time Δt2. In other words, even in a case where the conveyance of the recording sheet 184 is delayed in actuality, the movable supporting member 88 waits for the conveyance of the recording sheet 184. Accordingly, the recording sheet 184 conveyed can reliably cover the contact portion 111 of the movable supporting member 88 and the upper portion 113 of the non-contact portion 112 thereof, ink droplets ejected from the ink-jet recording head 39 do not adhere to the contact portion 111 of the movable supporting member 88 and the upper portion 113 of the non-contact portion 112 thereof. In addition, in the present embodiment, the time Δt2 is set to 2 seconds.

Further, as the movable supporting member is slid as mentioned above, the movable supporting member may always be disposed in the central portion of the platen. Accordingly, even in a case where recording with an edge is made, there is an advantage that a recording medium is not inclined on the platen, but is surely supported by the movable supporting member. Moreover, since ink droplets ejected from the ink-jet recording head 39 reach the recording sheet 184 and portions other than the upper portion 113, ink mist is not generated around the platen 42. As a result, the recording sheet 184 does not become dirty with ink, and high quality borderless recording is realized.

As such, in the composite device 10 according to the present embodiment, contamination of the recording sheet 184 can be prevented, thereby capable of performing high quality borderless recording even in a case where the conveying timing of the recording sheet 184 has deviated without sensing the leading edge position of the recording sheet 184 using a special sensor, and without separately controlling driving of the movable supporting member 88.

Particularly in the present embodiment, the movable supporting member 88 interlocks with the sheet discharge roller shaft 92 driven by the LF motor 71. Generally, in an ink-jet recording apparatus, a conveying roller is disposed in the vicinity of a recording head, and the power transmission mechanism 83 from the conveying roller 60 to the sheet discharge roller 62, the purging mechanism 51, etc. should be held in predetermined geometric positional relationship with respect to the conveying roller 60 and the ink-jet recording head 39. Accordingly, if the movable supporting member 88 obtains a driving force from the conveying roller 60 that is disposed close to the ink-jet recording head 39, then the design of the image recording unit 24 becomes difficult from the geometric positional relationship, and the mechanisms also become complicated. However, in the composite device 10 according to the present embodiment, the movable supporting member 88 obtains a driving force from the sheet discharge roller 62 that has a marginal space. Thus, the mechanisms are simplified and the compact design of the composite device 10 becomes possible.

Further, in the present embodiment, the rotating plate 125 is rotated with the rotation of the sheet discharge roller shaft 92. The lever member 126 that has engaged the rotating plate 125 converts the rotational amount of the rotating plate 125 into the amount of displacement in the conveying direction by a predetermined multiplication factor. Since the lever member 126 is engaged with the movable supporting member 88, the movable supporting member 88 is slid in synchronization with the conveyance of the recording sheet 184. Moreover, since the rotational amount of the rotating plate 125 is converted into the amount of displacement in the conveying direction by a predetermined multiplication factor by the lever member 126, the rotating plate 125 can be miniaturized. As a result, miniaturization of the composite device 10 is also promoted. Moreover, since the torque limiter 148 is interposed between the rotating plate 125 and the sheet discharge roller shaft 92 even if the rotation of the rotating plate 125 is regulated during the conveyance of the recording sheet 184, the sheet discharge roller shaft 92 is driven. That is, there is no hindrance to the conveyance of the recording sheet 184.

In the present embodiment, as the posture of the locking member 139 is changed, the rotation of the rotating plate 125 is regulated. Since the locking member 139 is resiliently urged so as to always engage the rotating plate 125, when image recording is generally made, the movable supporting member 88 is not slid to follow the recording sheet 184. For example, in a case where borderless recording is made, the carriage 38 releases the engagement between the locking member 139 and the rotating plate 125, and the movable supporting member 88 slides with the conveyance of the recording sheet 184 according to the aforementioned operation. That is, in the composite device 10 according to the present embodiment, the rotation regulating means 156 is configured simply and inexpensively.

Further, in the present embodiment, the recording sheet 184 conveyed on the platen 42 is first supported by the first fixed ribs 102, and is sent toward the second fixed ribs 103 through the groove 116. The groove 116 can catch ink droplets ejected from the ink-jet recording head 39 beyond the edges of the recording sheet 184 particularly when borderless recording is performed. For example, an ink absorber, such as a sheet-like sponge, may be laid at the bottom of the groove 116, ink droplets that have reached the inside of the groove 116 are surely absorbed by the ink absorber, and generation of ink mist is prevented more reliably.

Moreover, in the present embodiment, the recording sheet 184 is supported by the movable supporting member 88. Thus, the width 117 (see FIG. 9) of the groove 116 can be set large. This allows the ink-jet recording head 39 to become large-sized, and allows the groove 116 to cover the whole ink ejection region 118 of the ink-jet recording head 39 even if the ink-jet recording head 39 is made large-sized. As a result, there is an advantage that an increase in speed of borderless recording is also realized.

In particular, since members that support the recording sheet 184 are the first fixed ribs 102, the second fixed ribs 103, and the movable ribs 121, the structure of the members that support the recording sheet 184 is very simple. Moreover, the contact area between each of the ribs and the recording sheet 184 becomes small. Accordingly, the conveying resistance of the recording sheet 184 becomes small, and consequently, still smoother conveyance of the recording sheet 184 becomes possible.

In the present embodiment, the width 117 of the groove 116 is set to be wider than an ink ejection region 118 (see FIG. 6) of the ink-jet recording head 39. This allows all ink droplets to be caught by the groove 116 even if the ink droplets are ejected from all the nozzles 53 of the ink-jet recording head 39 if the recording sheet 184 is not disposed on the platen 42. Accordingly, when borderless recording is performed, recording of an image to the edges of the recording sheet 184 becomes possible while ink droplets are ejected from all the nozzles 53 of the ink-jet recording head 39. That is, borderless recording is performed at high speed, and complicated control becomes unnecessary concerning ejection of ink droplets from all the nozzles 53.

In other words, if the width 117 of the groove 116 is narrower than the ink ejection region 118 of the ink-jet recording head 39, in a case where borderless recording is performed on a portion of the leading edge of the recording sheet 184 in the conveying direction, ink droplets should be ejected only from upstream nozzles 53 of the ink-jet recording head 39, and ink droplets should be rejected sequentially even from downstream nozzles 53 with the conveyance of the recording sheet 184. That is, complicated control of the ink-jet recording head 39 becomes necessary. On the other hand, in the composite device 10 according to the present embodiment, such complicated control is unnecessary, and borderless recording to the edges of the recording sheet 184 is made possible by ejecting ink droplets from all the nozzles 53 as mentioned above. That is, control of ejection of ink droplets from the nozzles 53 is simple, and borderless recording is performed at high speed.

Moreover, in the present embodiment, the corners 122 and 123 of each of the movable ribs 121 of the movable supporting member 88 (see FIG. 10) is chamfered, and inclined portions are formed at the corners 122 and 123. This allows the edges of the recording sheet 184 to be smoothly guided on the movable supporting member 88 even if the edges of the recording sheet 184 that has passed by each of the first fixed ribs 102 abuts on the corner 122. Accordingly, there is no case that smooth conveyance of the recording sheet 184 is hindered due to provision of the movable supporting member 88. Further, as mentioned above, the corners of the first fixed ribs 102 and the second fixed ribs 103 are also chamfered, and the portions are constituted as inclined portions. For this reason, even if the recording sheet 184 during conveyance abuts on the corners of the first fixed ribs 102 and the second fixed ribs 103, smooth conveyance of the recording sheet 184 is not hindered.

11. Modification of Embodiment

Next, a modification of the present embodiment will be described.

Figure 20A:
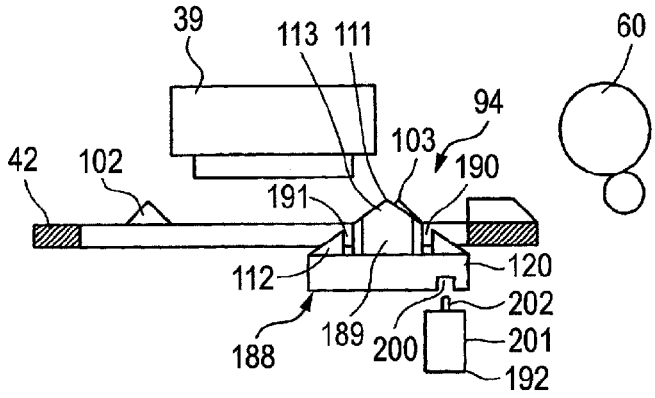
FIGS. 20A to 20C are views schematically shown the structure of the movable supporting member according to a modification of the present embodiment.
Figure 20B:
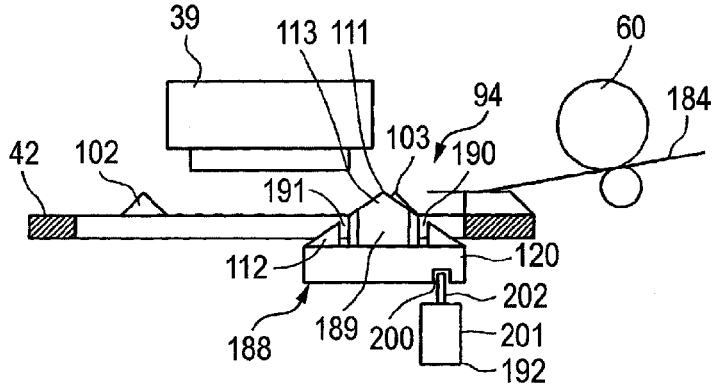
Figure 20C:
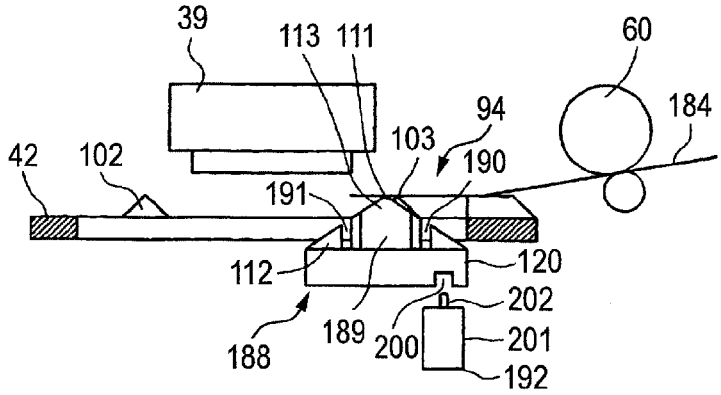

FIGS. 20A to 20C are views schematically shown the structure of the movable supporting member 188 according to a modification of the present embodiment. FIG. 17 is a view showing the positional relationship between the recording sheet 184 and the movable supporting member 188 during conveyance of the recording sheet 184, in order of (a) to (c).

The movable supporting member 188 according to the present modification is different from the movable supporting member 88 according to the above embodiment (1) in that the movable supporting member 188 includes a movable rib 189, and the movable rib 189 includes two recessed portions 190 and 191, (2) in that corners of the recessed portions 190 and 191 are formed in curved surfaces, and (3) in that the present embodiment is configured so that the locking member may engage the rotating plate 125 in order to fix the movable supporting member 88 to the upstream end 94 in the conveying direction, whereas the present modification is configured so that the actuator 192 may directly engage the movable supporting member 188.

Figure 21:
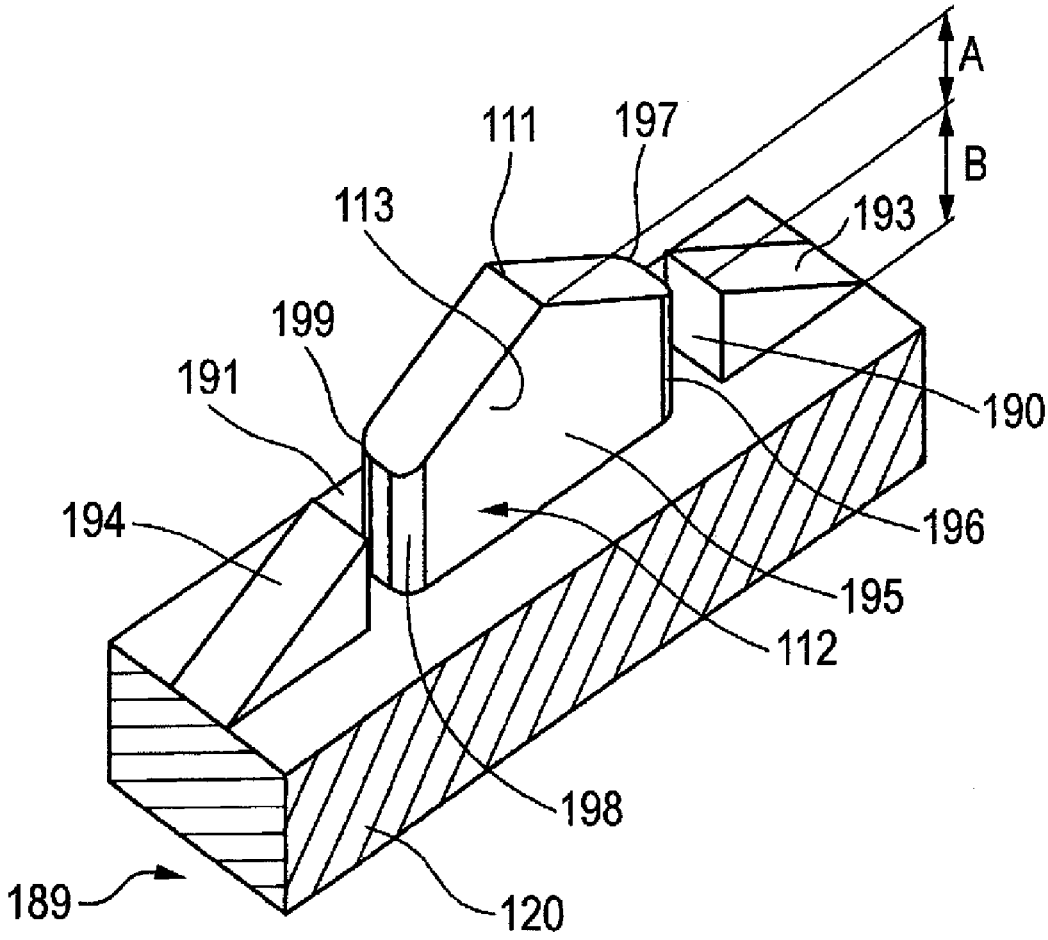
FIG. 21 is an enlarged perspective view of principal portions of a movable rib according to the modification of the present embodiment.
Figure 22:
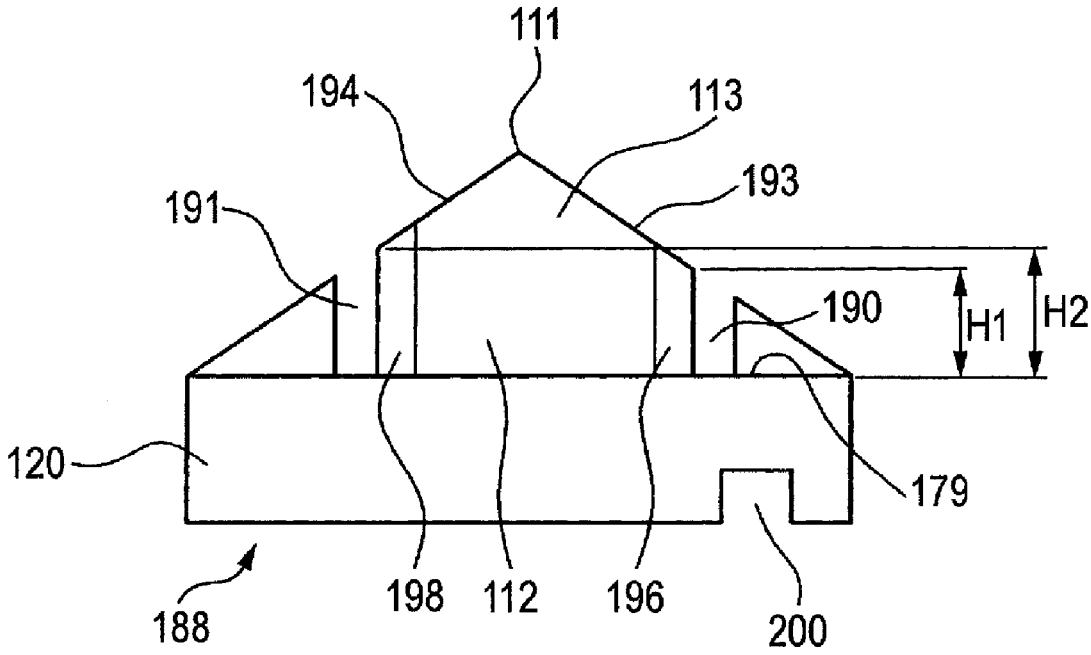
FIG. 22 is a front view of the movable rib according to the modification of the present embodiment.
Figure 23:
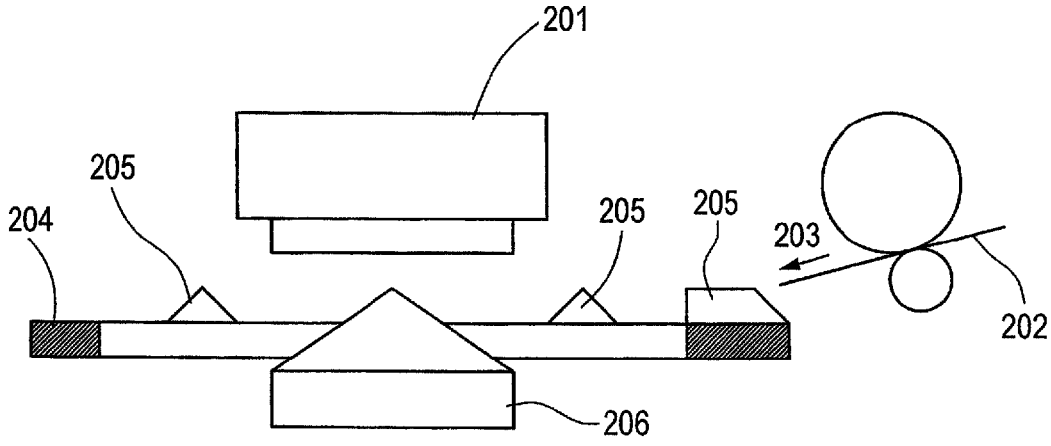
FIG. 23 is a view schematically showing the structure of an image recording unit of a conventional general ink-jet recording apparatus.
Figure 24A:
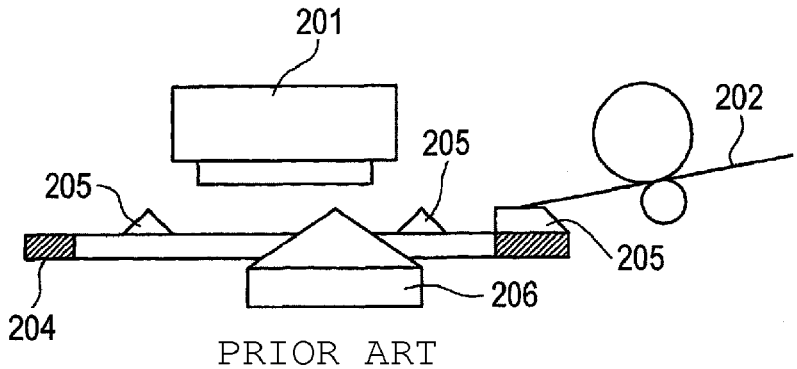
FIGS. 24A to 24C are views schematically showing the operation of sliding of a movable rib in the conventional ink-jet recording apparatus.
Figure 24B:
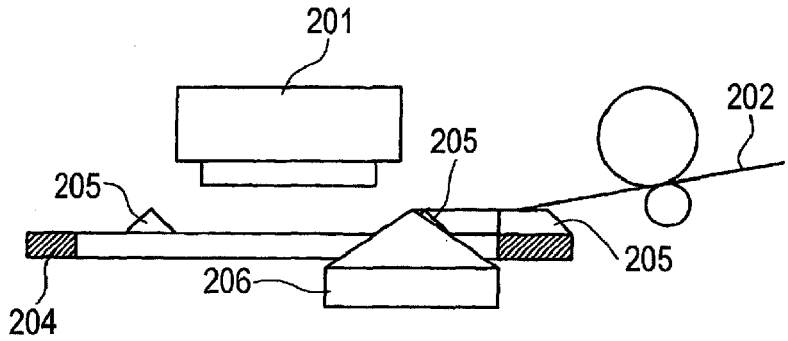
PRIOR ART FIG. 24B
Figure 24C:
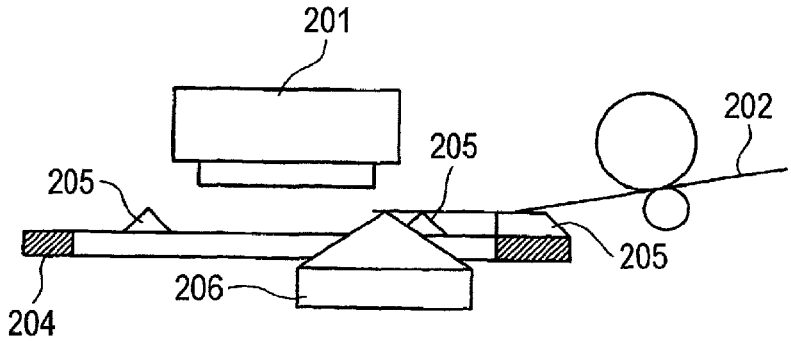
PRIOR ART FIG. 24C
Figure 25A:
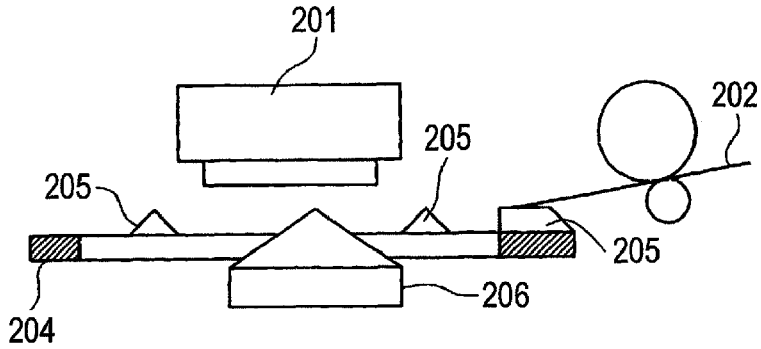
FIGS. 25A to 25C are views schematically showing the operation of sliding of the movable rib in the conventional ink-jet recording apparatus.
Figure 25B:
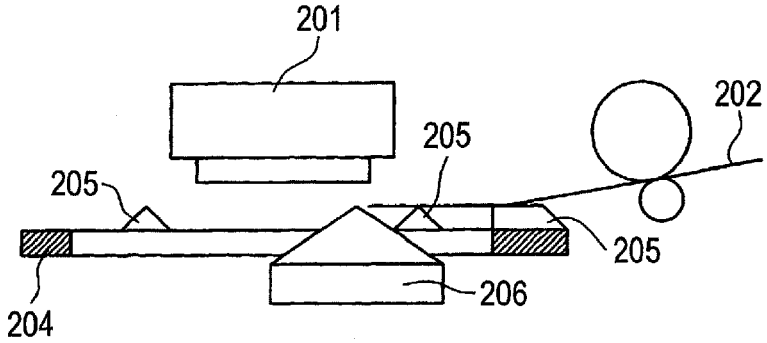
PRIOR ART FIG. 25B
Figure 25C:
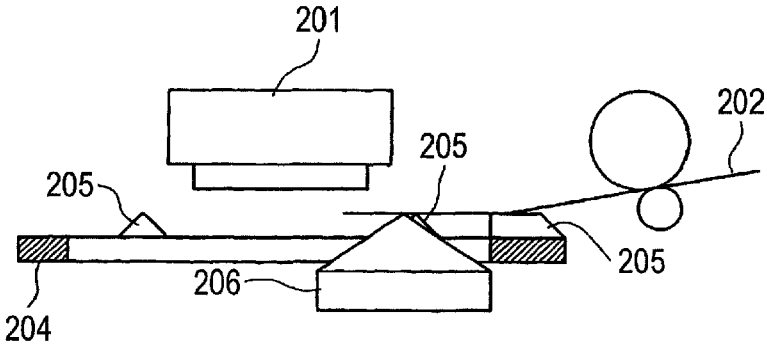
PRIOR ART FIG. 25C

FIG. 21 is an enlarged perspective view of principal portions of the movable rib 189. FIG. 22 is a front view of the movable rib 189.

The movable rib 189 is a thin-walled plate-like member. As shown in FIG. 21, the appearance of the movable rib 189 is formed in the shape of a triangle as a whole. The movable rib 189 includes a contact portion 111 that contacts a recording sheet 184 to support the recording sheet 184, and a non-contact portion 112 that is continuous with the contact portion 111 and does not contact the recording sheet 184. The contact portion 111 is constituted by an apex of the movable rib 189, and the non-contact portion 112 includes inclined portions 193 and 194 that are continuous with the apex of the movable rib 189. The inclined portion 193 extends to the upstream side in the conveying direction from the contact portion 111. The inclined portion 194 extends to the downstream side in the conveying direction from the contact portion 111.

A portion shown by a region A in this drawing is an upper portion 113 of the non-contact portion 112, and a portion shown by a region B is a lower portion 195 of the non-contact portion 112. The recessed portions 190 and 191 are provided between the upper portion 113 and the lower portion 195 of the non-contact portion 112. The recessed portions 190 and 191 are respectively constituted by slits that are cut in downward from upper edges of the inclined portions 193 and 194. As shown in FIG. 22, the height H1 of an upper end of the recessed portion 190 based on an top surface 179 of a base 120 is set lower than the height H2 of an upper end of the recessed portion 191. That is, the upstream recessed portion 190 in the conveying direction of the recording sheet 184 is located in a position lower than the downstream recessed portion 191 in the conveying direction.

As shown in FIGS. 21 and 22, corners 196 and 197 of the recessed portion 190 are chamfered, and corners 198 and 199 of the recessed portion 191 are chamfered. In the present embodiment, the corners 196 to 199 are formed into circular-arc surfaces. In addition, it is sufficient if the corners 196 to 199 are formed into smooth surfaces, not limited to the circular-arc surfaces.

As shown in FIGS. 20A to 20C, the base 120 of the movable supporting member 188 is provided with a fitting portion 200. On the other hand, the actuator 192 is fixed to the frame 100 of the platen 42. The actuator 192 includes a main body 201 and a stopper 202. The main body 201 has a solenoid built therein. As the solenoid operates, the posture of the stopper 202 changes between a posture (see FIG. 20B) in which the solenoid projects largely from the main body 201, and a posture (see FIGS. 20B and 20C) in which the solenoid retreats toward the main body 201. The operation of the stopper 202 can be controlled by the control unit 64 (see FIG.

8). As shown in FIG. 20B, as the stopper 202 projects from the main body 201, it fits into the fitting portion 200 provided in the movable supporting member 188. As the stopper 202 and the fitting portion 200 fits to each other, sliding of the movable supporting member 188 is regulated.

The composite device 10 according to the present modification has the following advantages.

If ink droplets ejected from the ink-jet recording head 39 become ink mist, generally, these adhere to the movable supporting member 188 or recording sheet 184, which causes degradation of image quality. In the composite device 10 according to the present modification, the movable rib 189 has the non-contact portion 112 in continuity with the contact portion 111 supporting the recording sheet 184, and the lower portion 195 of the non-contact portion 112 surely catches ink droplets that are scattered to the outside of the recording sheet 184. For this reason, generation of ink mist is prevented reliably. Further, there is a possibility that ink droplets adhering to the lower portion 195 of the non-contact portion 112 climbs up the inclined portions 193 and 194 grow up toward the contact portion 111. However, since the recessed portions 190 and 191 are provided between the upper portion 113 and lower portion 195 of the non-contact portion 112, ink droplets adhering to the non-contact portion 112 are prevented from growing up to the contact portion 111. That is, even in a case where the lower portion 195 of the non-contact portion 112 positively catches ink droplets in order to prevent generation of ink mist, the ink droplets are not transferred to the contact portion 111, and thus, soiling of the recording sheet 184 is prevented.

Meanwhile, the recording sheet 184 is conveyed from the upstream side to the downstream side in the conveying direction, as shown in FIGS. 20A to 20C. When the recording sheet 184 is conveyed on the platen 42, there is a possibility that the leading edge of the recording sheet 184 may enter the recessed portion 109. However, the recessed portion 190 is provided in a position lower than the recessed portion 191 provided on the downstream side in the conveying direction. That is, the recessed portion 190 is disposed in a sufficiently low position, and thereby, the leading edge of the recording sheet 184 is prevented from being caught by the recessed portion 190.

In the present modification, two recessed portions 190 and 191 are provided in the non-contact portion 112, but only the recessed portion 191 may be provided. Since ink droplets ejected from the ink-jet recording head 39 adheres mainly to the downstream side in the conveying direction of the non-contact portion 112, generation of ink mist is effectively prevented if the recessed portion 191 is provided. Moreover, if the recessed portion 190 is omitted, the recording sheet 184 conveyed to the platen 42 is reliably prevented from being caught by the non-contact portion 112.

Moreover, even if ink adheres to the corners 196 to 199 by forming the corners 196 to 199 of the recessed portions 190 and 191 into circular-arc surfaces or smooth surfaces, this ink will be hardly transferred along the corners 196 to 199. That is, ink hardly reaches the contact portion 111 along the corners 196 to 199, and accordingly, the recording sheet 184 is more reliably prevented from being soiled with ink during image recording.

According to the embodiments of the invention, an ink-jet recording apparatus includes: a platen that supports a recording medium conveyed in a conveying direction; a recording head that is disposed to face the platen to eject ink to the recording medium conveyed onto the platen while reciprocating in a main scanning direction orthogonal to the conveying direction, thereby recording an image; a movable supporting member that is connected to a motor for conveying the recording medium located on the platen, and is slid in the conveying direction while supporting the recording medium so as to follow the recording medium conveyed; and an interlocking mechanism that disposes the movable supporting member in an upstream given position in the conveying direction when the recording medium is conveyed to the upstream given position, then makes the movable supporting member stopped in the upstream given position until the recording medium overhangs the movable supporting member so as to cover a contact portion of the movable supporting member contacting the recording medium, and an upper portion of a non-contact portion of the movable supporting member continuous with the contact portion from above, and then makes the movable supporting member slide to the downstream side in the conveying direction while supporting edges of the recording medium with the conveyance of the recording medium.

A recording medium conveyed to a platen is supported by the platen. A recording head is disposed to face the platen. The recording head ejects ink while moving in a main scanning direction, thereby recording an image on the recording medium. The recording medium conveyed onto the platen is further conveyed in a conveying direction. At this time, the movable supporting member slides in the conveying direction while supporting the recording medium. That is, edges of the recording medium will always be supported by the movable supporting member. Accordingly, the edges of the recording medium are not flexed in the conveying direction, and the distance between the recording medium and the recording head is kept constant. And since a movable supporting member drives the motor for conveying the recording medium located on a platen via an interlocking mechanism as a driving source, smooth sliding is realized.

An interlocking mechanism makes the movable supporting member slide in the following way. The recording medium is conveyed to an upstream given position in the conveying direction before the recording head ejects ink. This upstream given position is a position outside the printing region on the platen. That is, ink ejected from the recording head cannot arrive at the upstream given position. The interlocking mechanism disposes the movable supporting member in the upstream given position in response to conveyance of a recording medium, and makes it stopped once at the upstream given position. At this time, since the recording medium continues being conveyed in the conveying direction, the recording medium overhangs the movable supporting member while the movable supporting member is stopped. Specifically, the recording medium covers the contact portion of the movable supporting member and an upper portion of the non-contact portion of the movable supporting member from above. Thereafter, the recording head ejects ink to start image formation, and the movable supporting member moves to the downstream side in the conveying direction while supporting edges of the recording medium with the conveyance of the recording medium. When the recording head ejects ink, the contact portion of the movable supporting member and the upper portion of the non-contact portion of the movable supporting member are covered with the recording medium. Therefore, the ink does not adhere to the contact portion and the upper portion of the non-contact portion.

In other words, this is as follows. The recording medium may be conveyed earlier than preset regular timing by predetermined time, or may be conveyed later than preset regular timing by predetermined time. Here, the "regular timing" is the timing with which a recording medium can cover the contact portion of the movable supporting member and the upper portion of the non-contact portion of the movable supporting member when the recording head ejects ink. In the embodiment, the movable supporting member moves to the upstream given position according to the early conveying timing assumed. Specifically, in a case where a recording medium conveyed is based on when a registration sensor is switched to an ON or OFF state, if the regular timing with which the movable supporting member starts sliding is defined as a time T1, the movable supporting member starts movement with the timing of a time (T1−Δt1). Accordingly, even in a case where conveyance of a recording medium becomes early in actuality, the movable supporting member moves early by the time Δt1 to the upstream given position. Thus, ink ejected from the recording head does not adhere to the contact portion of the movable supporting member, and the upper portion of the non-contact portion of the movable supporting member.

However, in a case where the movable supporting member moves to the upstream given position according to the early conveying timing assumed, a recording medium may actually be conveyed in synchronization with the regular timing, or the conveying timing may be later than the regular timing in some cases. Even in such a case, since the movable supporting member moves early to the upstream given position, ink ejected from the recording head is prevented from adhering to the contact portion of the movable supporting member and the upper portion of the non-contact portion of the movable supporting member.

Moreover, in the embodiment, the movable supporting member that has arrived at the upstream given position is once stopped at the upstream given position, and the timing with which the movable supporting member begins to move again is measured. Specifically, in a case where a recording medium conveyed is based on when a registration sensor is switched to an ON or OFF state, if the timing with which the movable supporting member has arrived at the upstream given position is defined as a time T2, the movable supporting member that is once stopped at the upstream given position starts movement with the timing of a time (T2−Δt2). Accordingly, even in a case where conveyance of a recording medium becomes late in actuality, the movable supporting member in the upstream given position does not return immediately after arriving at the upstream given position unlike a conventional technique, but the movable supporting member begins to move again after being delayed by the time Δt2. Thus, the recording medium conveyed can reliably cover the contact portion of the movable supporting member and the upper portion of the non-contact portion of the movable supporting member. That is, the ink ejected from the recording head does not adhere to the contact portion of the movable supporting member, and the upper portion of the non-contact portion of the movable supporting member.

Further, as the movable supporting member is slid as mentioned above, the movable supporting member can always be disposed in the central portion of the platen. Accordingly, even in a case where recording with an edge is made, there is an advantage that a recording medium is not inclined on the platen, but is surely supported by the movable supporting member.

Preferably, the motor drives a medium discharge roller shaft including a medium discharge roller that discharges the recording medium located on the platen along the conveying direction. Further, preferably, the movable supporting member is connected to, and is driven by the medium discharge roller shaft.

Generally, in an ink-jet recording apparatus, a conveying roller is disposed in the vicinity of a recording head, and a power transmission mechanism from the conveying roller to a medium discharge roller, a purging mechanism, a brushing mechanism, etc. should be held in predetermined geometric positional relationship with respect to the conveying roller and the recording head. Accordingly, if the movable supporting member obtains a driving force from the conveying roller that is disposed close to the recording head, then design becomes difficult from the geometric positional relationship, and the mechanisms also become complicated. However, in the embodiment, the movable supporting member obtains a driving force from the medium discharge roller that has some marginal space compared with the conveying roller. Thus, the mechanisms are simplified, and miniaturization of the whole ink-jet recording apparatus becomes possible.

The interlocking mechanism may have a rotating plate that is rotatably supported by a predetermined rotation center shaft provided in the platen, is connected with the medium discharge roller shaft via a torque limiter, and is rotated so as to interlock with the rotation of the medium discharge roller shaft; a rotation regulating means that regulates the rotation of the rotating plate if necessary; and a lever member that is engaged with an engaging portion that is provided in the rotating plate, and converts the rotational amount of the rotating plate into the amount of displacement in the conveying direction by a predetermined multiplication factor. Further, preferably, the movable supporting member is engaged with the lever member.

In this configuration, the rotating plate is rotated with the rotation of the medium discharge roller shaft. The lever member that has engaged the rotating plate converts the rotational amount of the rotating plate into the amount of displacement in the conveying direction by a predetermined multiplication factor. Since the lever member is engaged with the movable supporting member, the movable supporting member is slid in synchronization with the conveyance of the recording medium. Moreover, since the rotational amount of the rotating plate is converted into the amount of displacement in the conveying direction by a predetermined multiplication factor by the lever member, the rotating plate is miniaturized. As a result, miniaturization of the whole ink-jet recording apparatus is also promoted.

By providing the rotation regulating means, the rotation of the rotating plate is regulated with predetermined timing if necessary. As the rotation of the rotating plate is regulated, sliding of the movable supporting member is regulated as mentioned above. Moreover, since a torque limiter is interposed between the rotating plate and the medium discharge roller shaft even if the rotation of the rotating plate is regulated, the medium discharge roller shaft is driven. That is, there is no hindrance to the conveyance of the recording medium. In addition, in a case where the movable supporting member does not need to slide like, for example, a case where recording with an edge is made on a recording medium, the rotation of the rotating plate may be regulated by the rotation regulating means.

The rotation regulating means may include a locking member that is provided so that the posture thereof can be changed between a rotation regulation posture where the rotation of the rotating plate in the predetermined direction is regulated by engagement in a predetermined initial position of the rotating plate and a specific position of the rotating plate corresponding to a state where the movable supporting member is disposed in the upstream given position, and a rotation allowing posture where the rotation of the rotating plate is allowed as the engagement is released; a resilient member that resiliently urges the locking member so that the locking member may take the rotation regulation posture; and an abutting member that is provided in the locking member to forcibly displace the locking member to the rotation allowing posture as the recording head that slides in the main scanning direction abuts thereon.

In this configuration, since the locking member always engages the rotating plate, when image recording is generally made, the movable supporting member is not slid to follow the recording medium. Also, for example, in a case where borderless recording is made, the recording head abuts on the abutting member, thereby releasing the engagement between the locking member and the rotating plate. Thereby, the movable supporting member slides with the conveyance of a recording medium in the aforementioned way.

Recessed portions that extend downward from an upper edge of the non-contact portion are provided between upper and lower portions of the non-contact portion of the movable supporting member.

If ink ejected from the recording head becomes ink mist, these adhere to the movable supporting member or recording medium, which causes degradation of image quality. In the embodiment, the lower portion of the non-contact portion surely catches ink that is scattered the outside of the recording medium. For this reason, generation of ink mist is prevented reliably. Further, although ink adhering to the lower portion of the non-contact portion may grow up toward the contact portion, since the recessed portions are provided between the upper portion and lower portion of the non-contact portion, ink adhering to the non-contact portion is prevented from growing up to the contact portion. That is, even in a case where the lower portion of the non-contact portion positively catches ink in order to prevent generation of ink mist, the ink is prevented from growing up and soiling the contact portion.

Preferably, the upper edge of the non-contact portion extends to upstream and downstream sides in the conveying direction from the contact portion, respectively. Preferably, a recessed portion provided at an upstream edge portion in the conveying direction is in a position lower than a recessed portion provided at a downstream edge portion in the conveying direction.

Since a recording medium is conveyed from the downstream side to the downstream side in the conveying direction, when the recording medium is conveyed onto the platen, the leading edge of the recording medium may abut on the upstream edge portion in the conveying direction. In the embodiment, a recessed portion provided at an upstream edge portion in the conveying direction is in a position lower than a recessed portion provided at a downstream edge portion in the conveying direction. Therefore, the leading edge of the recording medium prevented from entering the recessed portions. That is, a recording medium can be conveyed smoothly.

Preferably, the recessed portion is provided only on the downstream side in the conveying direction.

In this configuration, the leading edge of a recording medium is reliably prevented from entering the recessed portion.

Preferably, corners of the recessed portion are smooth surfaces.

In this configuration, even if ink adheres to the corners, this ink will hardly flow along the corners. Accordingly, the ink hardly reaches the contact portion.

According to one embodiment of the invention, supposing any deviation of the conveying timing of a recording medium, the sliding initiation timing of the movable supporting member based on, for example, ON/OFF of a registration sensor is advanced, and return timing is delayed. Accordingly, even in a case where the conveying timing of a recording medium deviates in actuality when borderless recording is made, when the recording head ejects ink droplets particularly without sensing the position of a leading edge of a recording medium, the recording medium covers required portions of the movable supporting member, i.e., the contact portion that supports the recording medium, and the upper portion of the non-contact portion continuous with the contact portion. Accordingly, ink droplets do not adhere to the contact portion of the movable supporting member, and as a result, a recording medium is not soiled with ink. That is, an inexpensive ink-jet recording apparatus that realizes high-quality borderless recording by simple control is provided.

What is claimed is:

1. An ink-jet recording apparatus comprising:

a platen configured to support a recording medium conveyed in a conveying direction;

a recording head disposed to face the platen and configured to eject ink to the recording medium conveyed onto the platen while reciprocating in a main scanning direction orthogonal to the conveying direction, thereby recording an image;

a motor configured to generate energy to convey the recording medium located on the platen;

a movable supporting member connected to the motor and slidable in the conveying direction while supporting the recording medium to follow the recording medium conveyed, the movable supporting member comprising a contacting portion to contact the recording medium during the conveyance on the platen and a non-contact portion continuous with the contact portion, wherein an upper surface of the movable supporting member has a top portion and an inclined surface that extends from the top portion along the conveying direction and inclined toward downward from the top portion, at least the top portion protrudes from the platen, and the contact portion corresponds to the top portion;

a medium discharge roller shaft comprising a medium discharge roller configured to discharge the recording medium located on the platen along the conveying direction, wherein the motor drives the medium discharge roller shaft, and wherein the movable supporting member is connected to and driven by the medium discharge roller shaft; and an interlocking mechanism configured to control a movement of the movable supporting member, wherein the interlocking mechanism is operable to:

position the movable supporting member in a predetermined upstream position in the conveying direction when the recording medium is conveyed to the predetermined upstream position;

retain the movable supporting member in the predetermined upstream position until the recording medium overhangs the movable supporting member to cover the contact portion and at least a part of the non-contact portion; and slide the movable supporting member toward a downstream side in the conveying direction while supporting an edge of the recording medium with the conveyance of the recording medium.

2. The ink-jet recording apparatus according to claim 1, wherein the platen comprises a rotation center shaft, wherein the interlocking mechanism comprises:

a rotating plate rotatably supported by the rotation center shaft provided and connected with the medium discharge roller shaft via a torque limiter, thereby the rotating plate is configured to rotate to interlock with a rotation of the medium discharge roller shaft, the rotating plate comprising a lever engaging portion;

a rotation regulating member configured to regulate a rotation of the rotating plate at a predetermined timing; and a lever member engaged with the lever engaging portion of the rotating plate and engaged with the movable supporting member, and configured to convert a rotational amount of the rotating plate into an amount of displacement in the conveying direction by a predetermined multiplication factor.

3. The ink-jet recording apparatus according to claim 2, wherein the lever member is rotatably supported at a rotation support portion, the lever member comprising: a first portion engaged with the rotating plate; and a second portion engaged with the movable supporting member and positioned across the intermediate portion from the first portion, wherein a distance between the first portion and the rotation support portion is smaller than a distance between the second portion and the rotation support portion.

4. The ink-jet recording apparatus according to claim 2, wherein the rotation regulating member comprises:

a locking member provided so that the posture thereof is changeable between: a rotation regulation posture where the rotation of the rotating plate in a predetermined direction is regulated by an engagement with the rotating plate at an initial position of the rotating plate and at a specific position of the rotating plate corresponding to a state where the movable supporting member is positioned at the predetermined upstream position; and a rotation allowing posture where the rotation of the rotating plate is allowed as the engagement is released;

a resilient member that resiliently urges the locking member so that the locking member takes the rotation regulation posture; and an abutting member provided in the locking member and comprising an abutting portion on which the recording head is allowed to abut at a position within a movable range of the recording head in the main scanning direction, wherein the abutting member forcibly displace the locking member to the rotation allowing posture when the recording head slides to the position and abuts on the abutting portion.

5. The ink-jet recording apparatus according to claim 1, wherein the movable supporting member has a recessed portion that extend downward from a part of the inclined surface.

6. The ink-jet recording apparatus according to claim 5, wherein the inclined surface comprises a first inclined surface extending from the top portion toward an upstream side of the conveying direction and a second first inclined surface extending toward downstream side of the conveying direction, wherein the recessed portion comprises a first recessed portion provided at the first inclined surface and a second recessed portion provided at the second inclined surface, the first inclined surface at the first recessed portion is lower than the second inclined surface at the second recessed portion.

7. The recording apparatus according to claim 5, wherein the recessed portion is provided on a downstream side of the top portion in the conveying direction.

8. The ink-jet recording apparatus according to claim 5, wherein a corner extending downward of the recessed portion has a smooth curved surface.

* * * * *